US005678143A

United States Patent [19]

Nagahara et al.

[11] Patent Number: 5,678,143

[45] Date of Patent: Oct. 14, 1997

[54] IMAGE FORMING APPARATUS FOR COLLECTING RESIDUAL TONER FROM A DRUM USING AN AC VOLTAGE

[75] Inventors: Akira Nagahara; Sachio Sasaki; Mitsuhito Furukawa; Shigenobu Utaka; Yoshio Yamaguchi; Mitsuru Sato; Nobuo Kuwabara; Haruyasu Watanabe, all of Kawasaki; Takefumi Takahashi, Inagi, all of Japan

[73] Assignee: Fujitsu Limited, Kawasaki, Japan

[21] Appl. No.: 220,208

[22] Filed: Mar. 30, 1994

[30] Foreign Application Priority Data

Oct. 15, 1993 [JP] Japan ..... 5-281995

[51] Int. Cl.[6] ..... G03G 15/24; G03G 15/00

[52] U.S. Cl. ..... 399/150; 399/18; 399/98; 399/128

[58] Field of Search ..... 355/269, 270, 355/219, 222, 296, 299, 301; 399/71, 21, 19, 18, 149, 150, 357, 354, 98, 174, 175, 176, 343, 129, 128

[56] References Cited

U.S. PATENT DOCUMENTS

| | | | |
|---|---|---|---|
| 5,055,882 | 10/1991 | Fushimi | 355/269 |
| 5,066,982 | 11/1991 | Hosoya et al. | 355/270 X |
| 5,231,456 | 7/1993 | Kikuchi et al. | 355/270 |
| 5,241,343 | 8/1993 | Nishio | 355/219 |
| 5,323,215 | 6/1994 | Ohtaka et al. | 355/269 |
| 5,333,041 | 7/1994 | Ito et al. | 355/270 |
| 5,587,774 | 12/1996 | Nagahara et al. | 399/176 |
| 5,610,697 | 3/1997 | Arai | 399/149 |

FOREIGN PATENT DOCUMENTS

| | | | |
|---|---|---|---|
| 0037248 | 10/1981 | European Pat. Off. | 355/299 |
| 0501151A2 | 9/1992 | European Pat. Off. | 355/301 |
| 2553965 | 7/1976 | Germany | 355/299 |
| 53-129642 | 11/1978 | Japan . | |
| 57-64279 | 4/1982 | Japan | 355/219 |
| 61-279881 | 12/1986 | Japan | 355/299 |
| 1-020586 | 1/1989 | Japan | 355/299 |
| 2-211481 | 8/1990 | Japan | 355/299 |
| 3-252686 | 11/1991 | Japan . | |
| 4-51073 | 2/1992 | Japan | 355/219 |
| 4-178663 | 6/1992 | Japan | 355/296 |
| 5-181392 | 7/1993 | Japan | 355/296 |

OTHER PUBLICATIONS

Hosoya et al., "Cleanerless Laser Printer Using Monocomponent Nonmagnetic Development System", Jul. 16, 1991, pp. 29–37.

*Primary Examiner*—S. Lee

*Attorney, Agent, or Firm*—Armstrong, Westerman, Hattori, McLeland & Naughton

[57] ABSTRACT

An image forming apparatus for forming an image on a sheet, including a rotary endless latent image carrier, an image forming device for forming an electrostatic latent image on a latent image carrier, a developing device for developing the electrostatic latent image on the latent image carrier with powdery developers and collecting residual toners on the latent image carrier at the same time, a transfer device for transferring a developed image on the latent image carrier onto a sheet, a distribution roller having independent foam perforations for distributing residual toners on the latent image carrier when in contact with the latent image carrier after image transfer, and a power supply for supplying an AC voltage to the distribution member. The distribution member is made of a conductive foam member having a pore at a surface contacting with the latent image carrier and the roller rotates in a direction opposite to a rotational direction of the latent image carrier at a peripheral velocity of 1.1 to 1.5 times that of the latent image carrier.

19 Claims, 27 Drawing Sheets

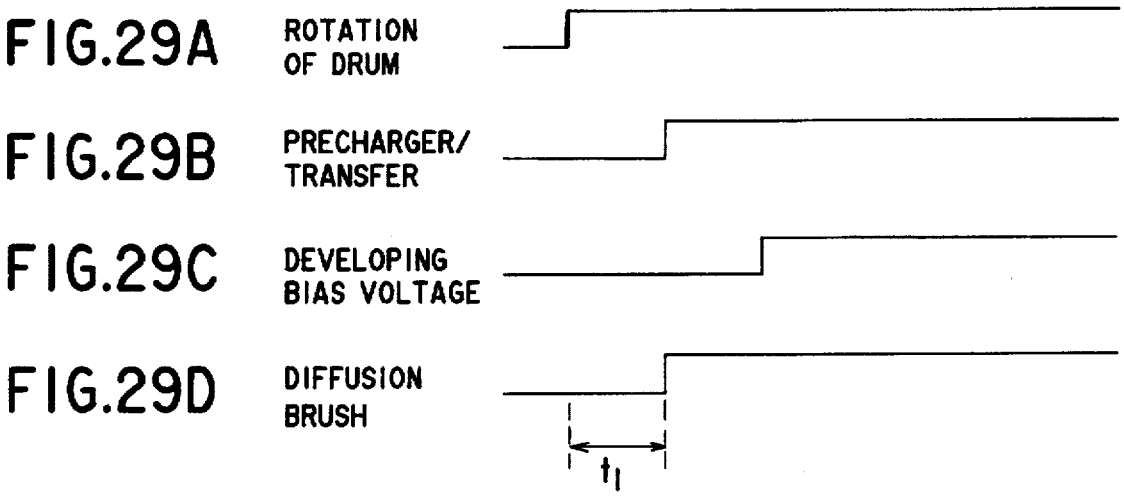
FIG.30
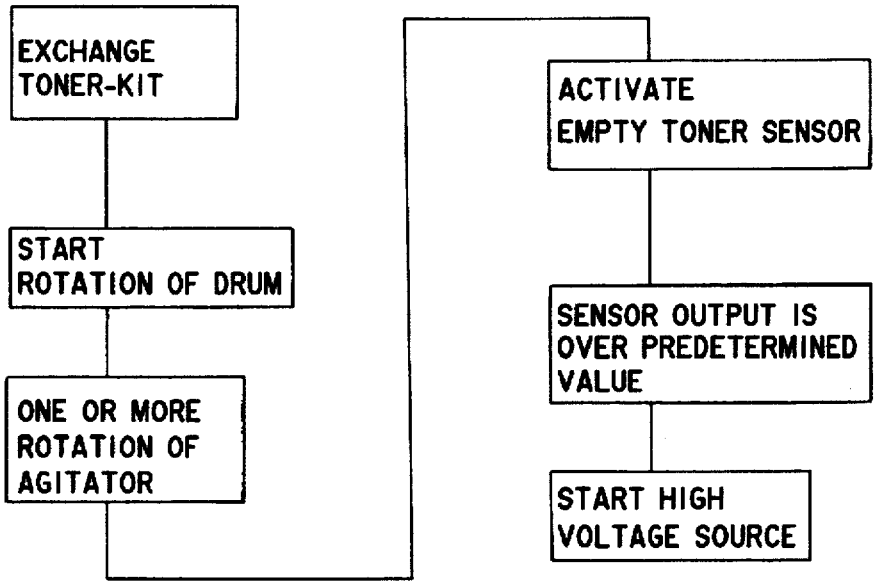

IMAGE FORMING APPARATUS FOR COLLECTING RESIDUAL TONER FROM A DRUM USING AN AC VOLTAGE

BACKGROUND OF THE INVENTION

1. Field of the Invention

The present invention relates to an image forming apparatus which will collect residual toners latent image carrier in a developing unit.

2. Description of the Related Art

In image recording apparatuses, such as a copying machine, a printer and a facsimile, a latent image forming apparatus like an electrophotographic apparatus is used due to the popularity of image recording on normal sheets of paper. Such an image forming apparatus forms an electrostatic latent image on a photosensitive drum or the like. Then, the electrostatic latent image on the photosensitive drum is developed with a powder developer to provide a visible image. The developed image on the photosensitive drum is then transferred on a sheet, which in turn is separated from the photosensitive drum. Thereafter, the developed image on the sheet is fixed.

The efficiency of transferring the developer on a sheet is not 100%, and some toners (developer) will remain on the photosensitive drum. Therefore, the residual toners should be cleaned off. A cleaner is thus provided to remove the residual toners. This residual-toner removing process requires a mechanism for storing the residual toners, thus inevitably enlarging the image forming apparatus. As the toners collected by the cleaner do not contribute to printing, this process is not economical. Further, the disposal of the toners will raise an environmental problem. In this respect, it is desirable to develop and use an image forming process which does not waste or dispose of toners.

FIG. 31 is an explanatory diagram of prior art.

Such an image forming apparatus will be described below as an electrophotographic printer. As shown in FIG. 31, after a precharger 91 uniformly charges the surface of a photosensitive drum 90, an exposing unit 92 exposes the photosensitive drum 90 to a light image to form an electrostatic latent image thereon. A developing unit 93 is provided to develop the electrostatic latent image on the photosensitive drum 90. This developing unit 93 supplies a powder developer (e.g., one-component magnetic toners or a two-component developer) to the photosensitive drum 90 to develop the electrostatic latent image.

A transfer unit 94 transfers the developed image on the photosensitive drum 90 onto a sheet that has been fed out from a sheet cassette not shown. The sheet carrying the transferred image is fed to a fixing unit 96 where the developed image is fixed on the sheet. The residual toners on the photosensitive drum 90 after image transfer are distributed over the drum 90 by a distribution brush 95.

In this recording process, the residual toners on the photosensitive drum 90 after image transfer are distributed by the distribution (uniform) brush 95. Thereafter, the surface of the photosensitive drum 90 with toners sticking thereon is evenly charged by the corona charger 91, image exposure is performed by the exposing unit 92 and the residual toners are collected at the same time as image developing is carried out in the developing unit 93.

The distribution brush 95 distributes the toners concentrating locally to reduce the amount of toners per unit area, so that the toner collection by the developing unit 93 becomes easier. Further, the brush 95 suppresses the effect of filtering the ion shower of the corona charger 91 by the toners and provides a uniform charged potential. In addition, the image filtering effect by the toners in the image exposing process will also be suppressed to properly expose the photosensitive drum 90 to a light image.

The key point of this recording process is to collect the toners on the photosensitive drum 90 at the same time as the developing process is carried out. This will be further discussed below with reference to the case where the photosensitive drum 90 and the toners are both charged negatively. The surface potential of the photosensitive drum 90 is set to −500 to −1000 V by the charger 91. The exposed portion of the photosensitive drum 90 whose potential has dropped by image exposure will have a reduced potential of 0 to minus several tens of volts, forming an electrostatic latent image. At the time of developing the latent image, a developing bias voltage (e.g., −300 V), which is an almost middle of the surface potential and the potential of the latent image, is applied to the developing rollers of the developing unit 93.

In the developing process, the negatively charged toners sticking on the developing rollers are adhered to the electrostatic latent image on the photosensitive drum 90, forming a toner image, by an electric field that is created by the developing bias voltage and the potential of the latent image. In the cleanerless process, the residual toners after image transfer which have been distributed over the photosensitive drum 90 in the uniform distribution process by the distribution brush 95 are collected from the photosensitive drum 90 by the developing rollers by the electric field, generated by the surface potential and latent image potential.

In such a cleanerless process, the conventional distribution brush simply performs mechanical sweeping of the photosensitive drum to distribute the residual toners, so that it is difficult to sufficiently distribute toners which are locally concentrating. Further, a separate de-electrifying lamp is needed to eliminate the residual charges of the photosensitive drum.

SUMMARY OF THE INVENTION

It is therefore a primary object of the present invention to provide an image forming apparatus which will sufficiently distribute residual toners to facilitate the collection of the residual toners in a developing unit.

It is another object of the present invention to provide an image forming apparatus which will distribute residual toners and de-electrify residual charges.

To achieve the foregoing and other objects in accordance with the purpose of the present invention, according to one aspect of the present invention, an image forming apparatus comprises a rotary endless latent image carrier; an image forming unit for forming an electrostatic latent image on the latent image carrier; a developing unit for developing the electrostatic latent image on the latent image carrier with a powdery developer and collecting residual toners on the latent image carrier at a same time; a transfer unit for transferring the developed image on the latent image carrier onto a sheet; a distribution member for distributing residual toners on the latent image carrier when in contact with the latent image carrier after image transfer; and a voltage supplying unit for supplying an AC voltage to the distribution member.

According to this aspect, the residual toners on the latent image carrier are moved forward and backward by applying an AC voltage to the distribution member. That is, the residual toners, which are difficult to be moved by a mechanical means alone, are separated from the latent image carrier and then put back thereon again, so that those toners will be properly distributed over the latent image carrier. It is therefore possible to prevent the concentration of residual toners and facilitate the collection of the residual toners in the developing unit. It is also possible to de-electrify the residual charges on the latent image carrier by the applied AC voltage.

According to another aspect of the present invention, an image forming apparatus comprises a rotary endless latent image carrier; an image forming unit for forming an electrostatic latent image on the latent image carrier; a developing unit for developing the electrostatic latent image on the latent image carrier with a powdery developer and collecting residual toners on the latent image carrier at a same time; a transfer unit for transferring the developed image on the latent image carrier onto a sheet; and a distribution roller for distributing residual toners on the latent image carrier when in contact with the latent image carrier after image transfer.

According to this aspect, the distribution roller is used to increase the mechanical distributing power as compared with a distribution brush. Therefore, the residual toners, which are difficult to be moved by a mechanical means, will be properly distributed over the latent image carrier. It is therefore possible to prevent the concentration of residual toners and facilitate the collection of the residual toners in the developing unit.

Other features and advantages of the present invention will become readily apparent from the following description taken in conjunction with the accompanying drawings.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiments given below, serve to explain the principles of the invention.

FIG. 29 is an explanatory diagram of a sequence at the time a toner kit is exchanged;

FIG. 30 is a flowchart for the toner-kit exchanging sequence in FIG. 29;

DETAILED DESCRIPTION OF THE PREFERRED EMBODIMENT

Figure 1A:
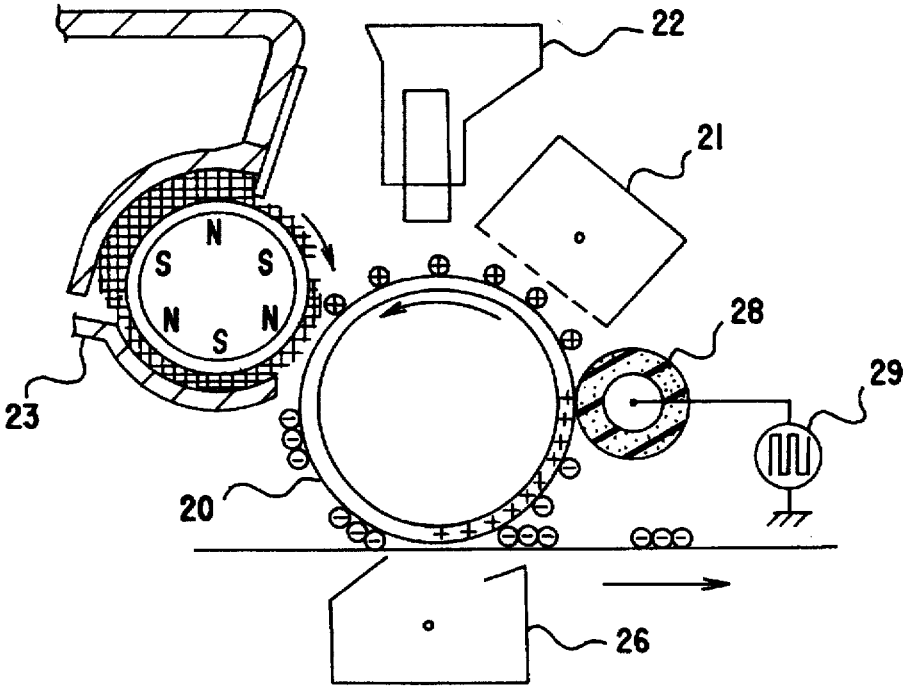
FIGS. 1A and 1B are diagrams for explaining the principle of the present invention.
Figure 1B:
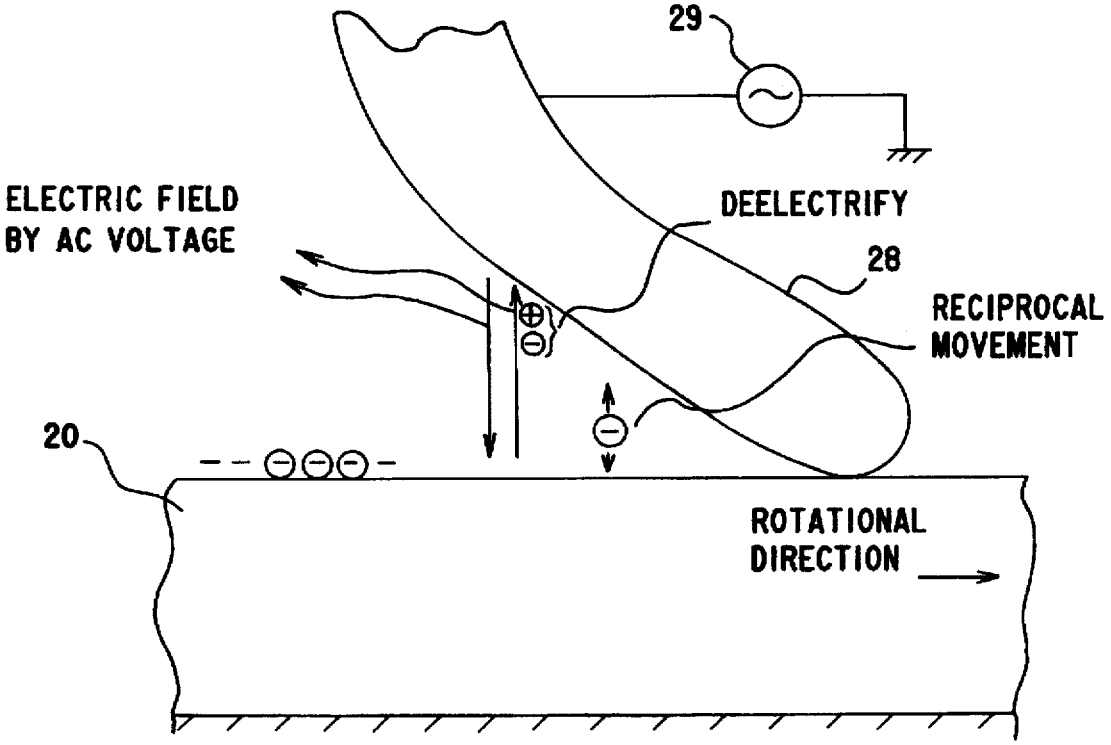

FIGS. 1A and 1B are diagrams for explaining the principle of the present invention.

As shown in FIG. 1A, a precharger 21, an exposing unit 22, a developing unit 23 and a transfer unit 26 are provided around a photosensitive drum 20. A distribution roller 28 is disposed between the transfer unit 26 and the precharger 21. This distribution roller 28 rotates in the opposite direction to the rotational direction of the photosensitive drum 20 to distribute the residual toners on the drum 20.

An AC power supply 29 is connected to the distribution roller 28. When an AC voltage is applied to the distribution roller 28 from the AC power supply 29, the residual toners on the photosensitive drum 20 are electrically moved back and forth. Therefore, the toners are distributed electrically as well as mechanically, thus improving the toner distributing effect of the distribution member 28. Further, the AC electric field created by the applied AC voltage de-electrifies the photosensitive drum 20.

Figure 2:
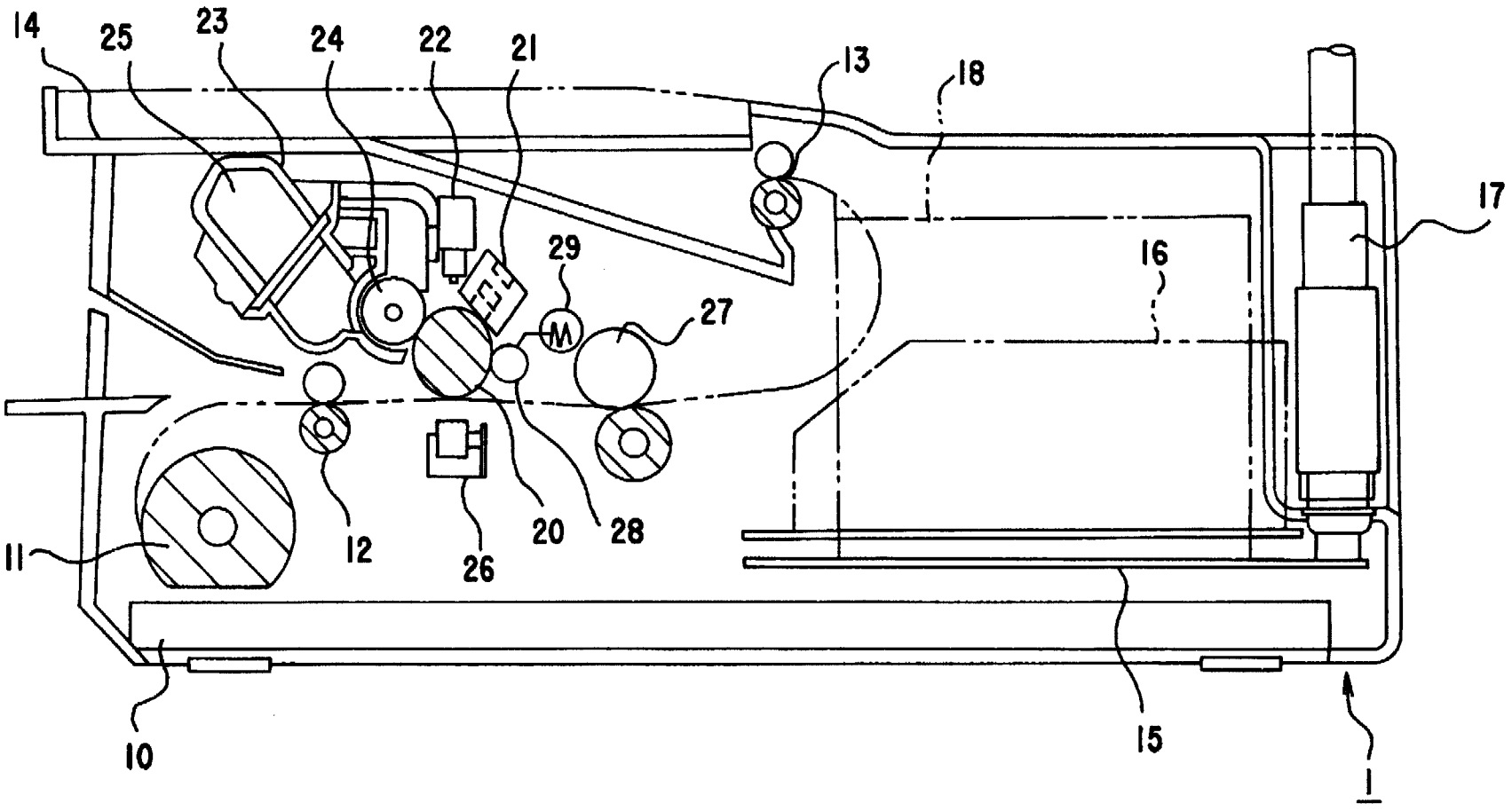
FIG. 2 is a structural diagram of one embodiment of the present invention.
Figure 3:
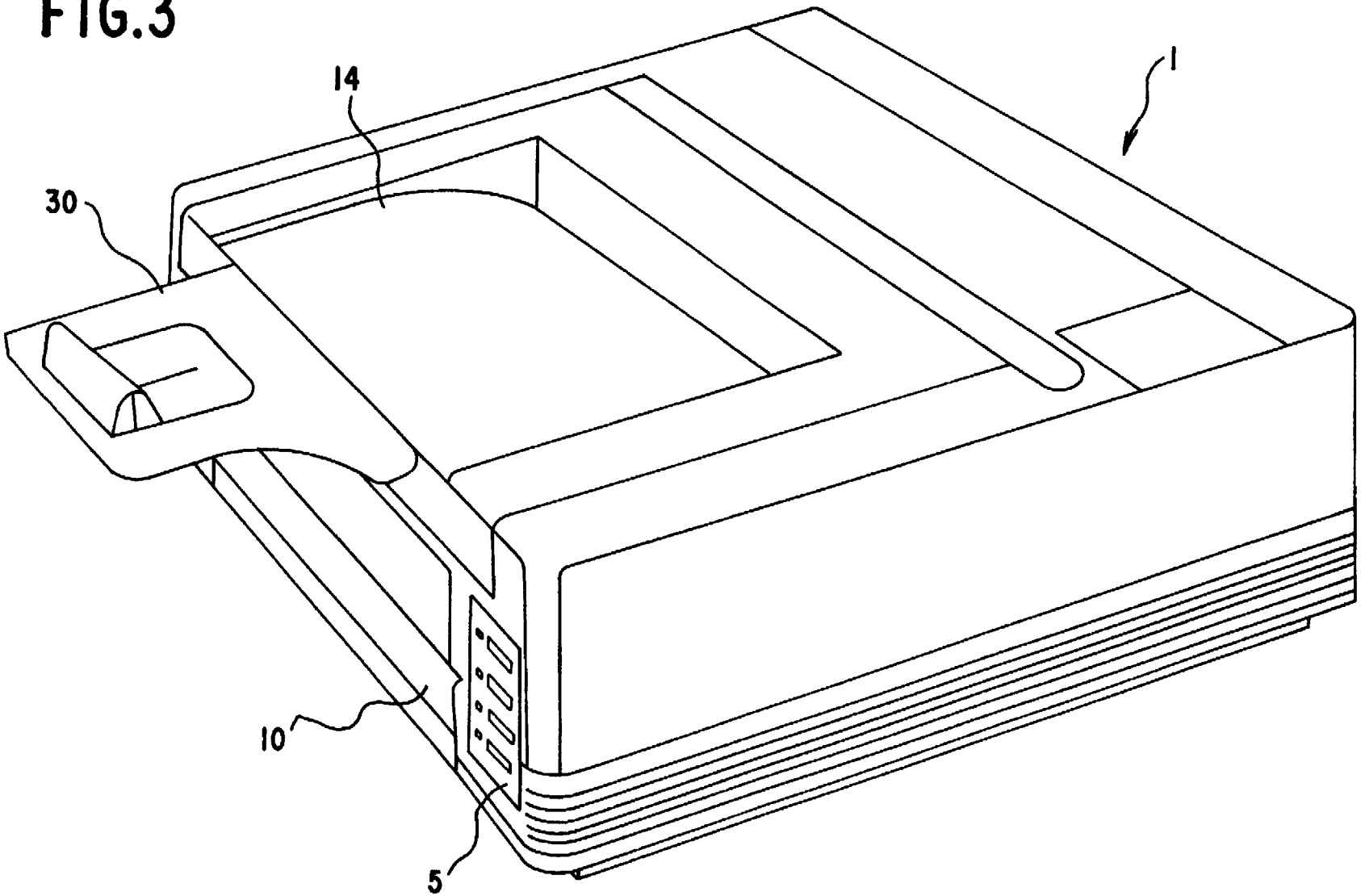
FIG. 3 is a diagram showing the apparatus in FIG. 2 in a horizontal position.
Figure 4:
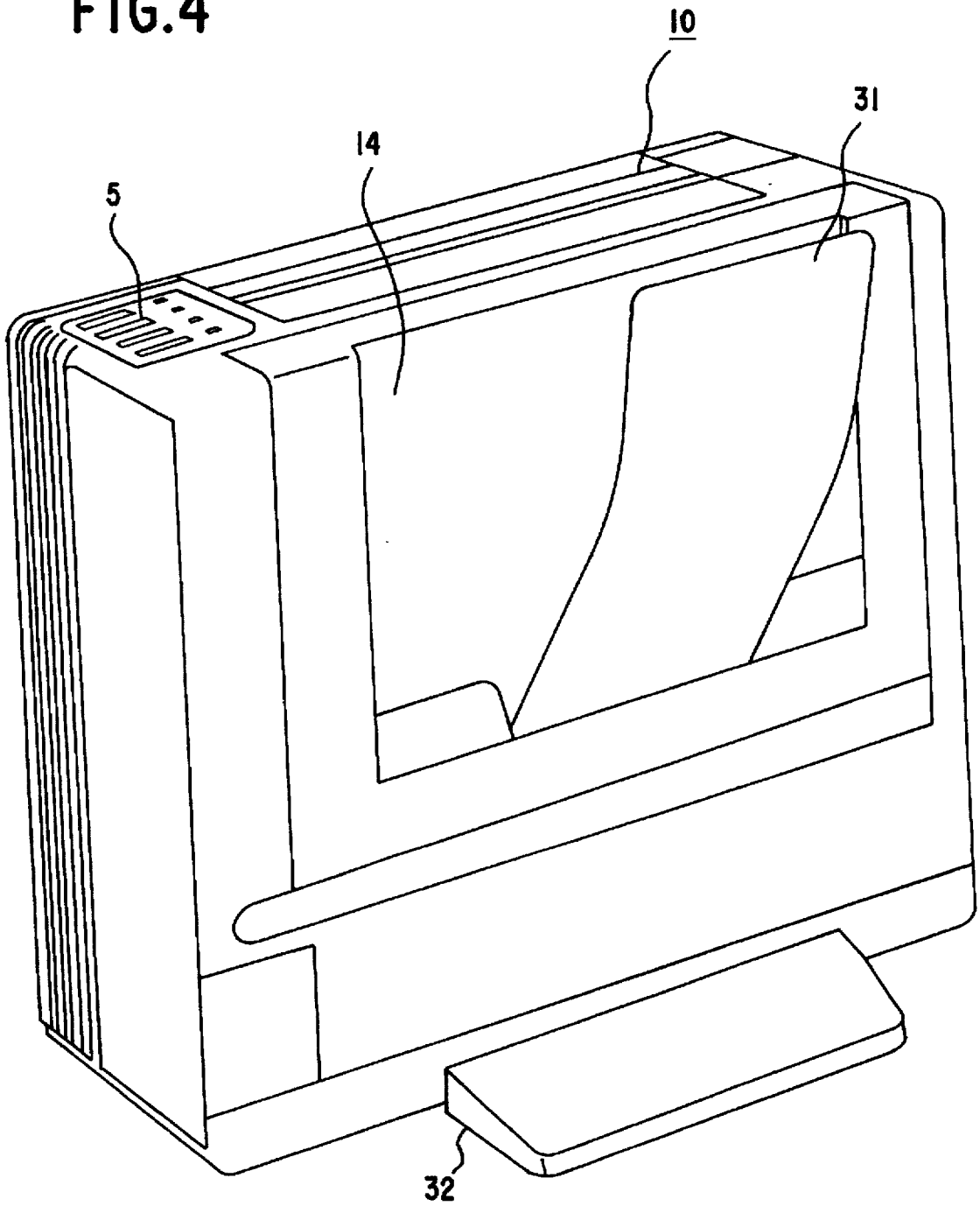
FIG. 4 s a diagram showing the apparatus in FIG. 2 in an upright position.

FIG. 2 is a structural diagram of one embodiment of the present invention, FIG. 3 is a diagram showing the apparatus in FIG. 2 in a horizontal position, and FIG. 4 is a diagram showing the apparatus in FIG. 2 in an upright position. The diagrams illustrate an electrophotographing printer.

Referring to FIG. 2, a photosensitive drum 20 is an aluminum drum on which a functionally separate organic photosensitive body is coated about 20 microns thick. This photosensitive drum 1 has an outside diameter of 24 mm and rotates at a peripheral velocity of 25 mm/s in the counter-clockwise direction indicated by the arrow. A precharger 21 is a non-contact type charger constituted of a Scolotron. This precharger 21 uniformly charges the surface of the photosensitive drum 20 to −650 V.

An optical unit 22 exposes the photosensitive drum 20 to image light to form an electrostatic latent image. This optical unit 22 in use is an LED optical system which has an LED array combined with a self-focus array. This optical unit 22 exposes the photosensitive drum 20 to image light in accordance with an image pattern to form an electrostatic latent image. The potential of the latent image portion becomes −50 to −100 V.

A developing unit 23 supplies a developer, which consists of a magnetic carrier and magnetic toners, to the electrostatic latent image on the photosensitive drum 20 to provide a visible toner image. This developing unit 23 will be discussed later with reference to FIG. 5 and subsequence drawings. Developing rollers 24 feed a developer to the photosensitive drum 20. A toner cartridge 25, which is filled with magnetic toners, is detachably attached to the developing unit 23. The toner cartridge 25 is exchangeable in a toner empty status to supplement magnetic toners to the developing unit 23.

A transfer unit 26 is constituted of a corona discharger. This transfer unit 26 electrostatically transfers the toner image on the photosensitive drum 20, onto a sheet. A voltage of +3 KV to +10 KV is applied to a corona wire from a power supply so that electric charges will be generated by corona discharging. The back of the sheet is charged with the electric charges so that the toner image on the photosensitive drum 20 is transferred on the sheet P. It is desirable that this power supply be a constant current source which supplies a constant amount of charges to the sheet to thereby reduce the deterioration of the transfer efficiency due to the environmental conditions.

A fixing unit 27 thermally fixes the toner image on the sheet. This fixing unit 27 comprises a heat roller having a halogen lamp incorporated therein as a heat source, and heat rollers (backup rollers), and heats the sheet to fix the toner image on the sheet.

A uniform distribution brush 28 is made of a conductive member. When in contact with the photosensitive drum 20, the distribution brush 28 distributes the concentrated residual toners on the photosensitive drum 20 to facilitate the toner collection in the developing unit 23. An AC power supply 29 applies an AC voltage to this uniform distribution brush 28 to separate the residual toners from the photosensitive drum 20 and place the toners back on the drum 20. As a result, the residual toners will properly be distributed over the photosensitive drum 20. This scheme will also prevent filming of the toners. Further, a voltage equal to or greater than the voltage needed to start discharging may be applied to the brush 28 to de-electrify the photosensitive drum 20, in which case a residual positive image formed by the residual charges will be eliminated.

A sheet cassette 10, which retains sheets, is detachably attached to the printer. This sheet cassette 10 is installed at the lower portion of the printer and can be attached to or detached from the printer from the front side of the printer, which is on the left-hand side in FIG. 2. Pickup rollers 11 serve to pick up sheets from the sheet cassette 10. Resist rollers 12 align the leading edge of a picked sheet when it abuts on the rollers 12 before feeding the sheet to the transfer unit 26. Discharge rollers 13 discharge the sheet after image fixing onto a stacker 14. The stacker 14 is provided on the top of the printer to receive the discharged sheet.

A printed circuit board 15 has a printer controller installed thereon. A power supply 16 supplies power to the individual sections of the printer. An interface connector 17 is connected to an external cable at one end and is inserted in the printer at the other end to be connected to the connector of the printed circuit bard 15. An optional board 18 has another type of emulator circuit, font memory, etc. installed thereon.

The operation of this embodiment will be described below. After the surface of the photosensitive drum 20 is evenly charged to −650 V by the Scolotron charger 21, image exposure is performed by the LED optical system 22 to form an electrostatic latent image with the background portion charged to −650 V and the exposed or printing portion charged to −50 to −100 V, on the photosensitive drum 20.

A developing bias voltage (−300 V) is applied to the sleeves of the developing rollers 24 of the developing unit 23. Therefore, the electrostatic latent image is developed by magnetic polymerization toners, which have previously been stirred with a carrier to have been charged negatively, in the developing unit 23, yielding a toner image.

Meanwhile, a sheet is picked up from the sheet cassette 10 by the pickup rollers 11 and its leading edge is aligned by the resist rollers 12 before being sent to the transfer unit 26. The toner image on the photosensitive drum 20 is transferred onto the sheet by electrostatic force by the transfer unit 26. The toner image on the sheet is fixed by the fixing unit 27, and is fed along an U-shaped feeding path to be discharged on the stacker 14 by the discharge rollers 13.

After the image transfer, the distribution member 28 distributes the residual toners on the photosensitive drum 20 and removes the residual charges. The residual toners on the drum 20 pass through the Scolotron charger 21 and LED optical system 22 to reach the developing unit 23 and are collected by the developing rollers 24 at the same time as the next developing process starts. The collected toners will be used again in the developing unit 23.

Because of no cleaner used and other reasons, this printer will be designed very compact; the printer in FIG. 2 is 350 mm long including the length of the sheet cassette 10, 345 mm wide and 130 mm tall. This printer will be easily placed on the top of a desk as a personal-usage printer.

Further, this printer can be placed in a horizontal position with the sheet cassette 10 extending in parallel to the siting surface, as shown in FIG. 3. In this diagram, an operation panel 5 is provided on the front face of the printer to indicate the operation of the printer. A sheet guide 30 is provided at the distal end of the stacker 14. This sheet guide 30 serves to press and align the leading edge the sheet that is to be discharged on the stacker 14.

In this embodiment, the sheet cassette 10 can be attached to and detached from the front side of the printer and the operation panel 5 is operable also from the front side. In addition, the sheet is discharged to the front of the printer.

As shown in FIG. 4, image formation is possible in an upright position where the interface connector 17 of the printer in FIG. 2 is provided on the siting surface, and the sheet cassette 10 is set upright to be perpendicular to the siting surface. This reduces the siting space further. At this time, a sheet presser 31 may be provided on the stacker 14 to press sheets to be discharged on the stacker so that the sheets will not fall down even when the printer is placed upright. If a stand 32 is provided at the siting surface side of the printer as illustrated, the printer even in an upright position stay stably.

Even without the cleanerless process, as the precharger 21 and the transfer unit 26 are constituted of a non-contact type discharger, the toners on the photosensitive drum 20 will not stick on those units, so that the uniform charging and image transfer can be accomplished stably.

Figure 5:
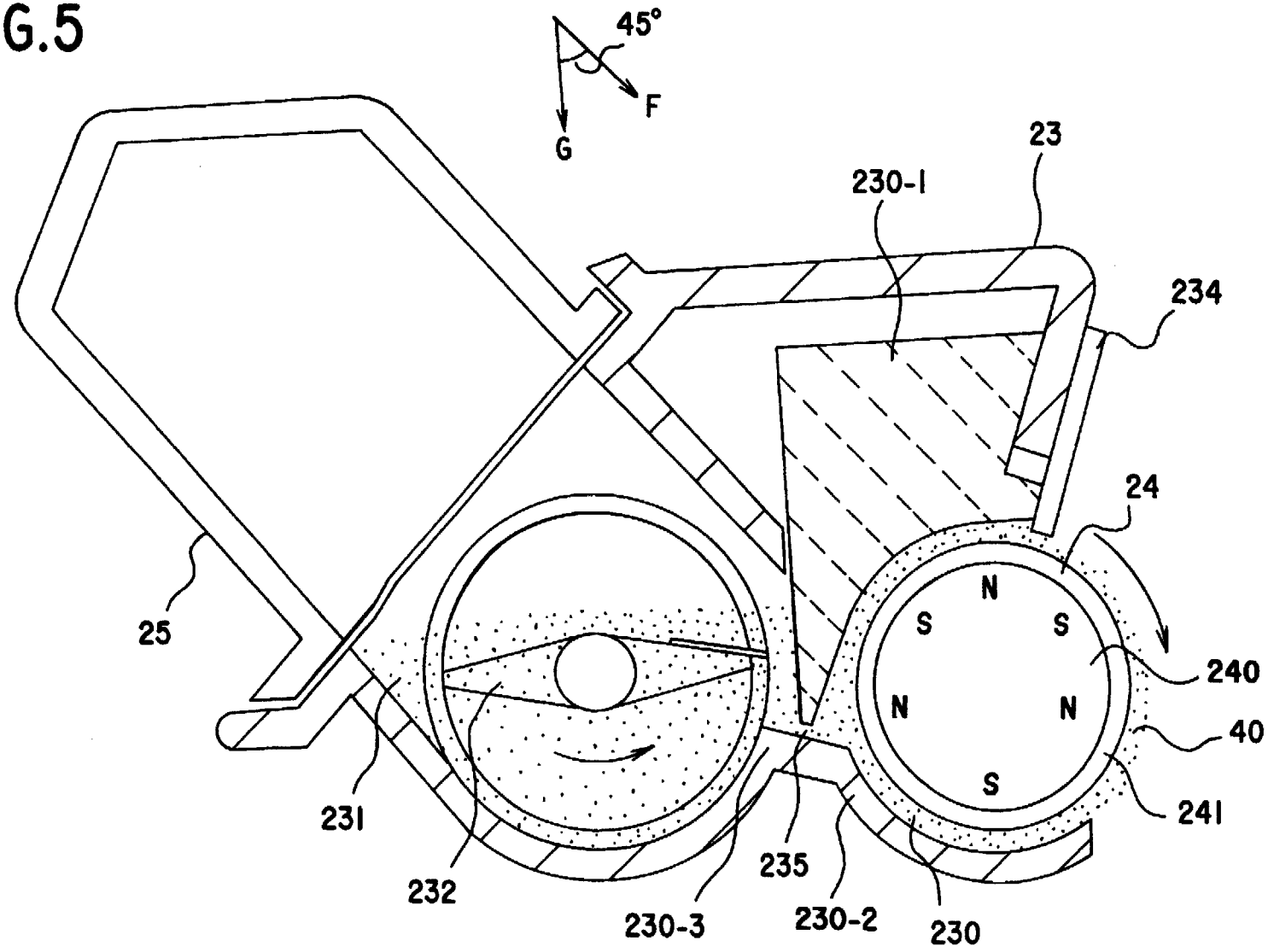
FIG. 5 s a structural diagram of a developing unit in FIG. 2.
Figure 6:
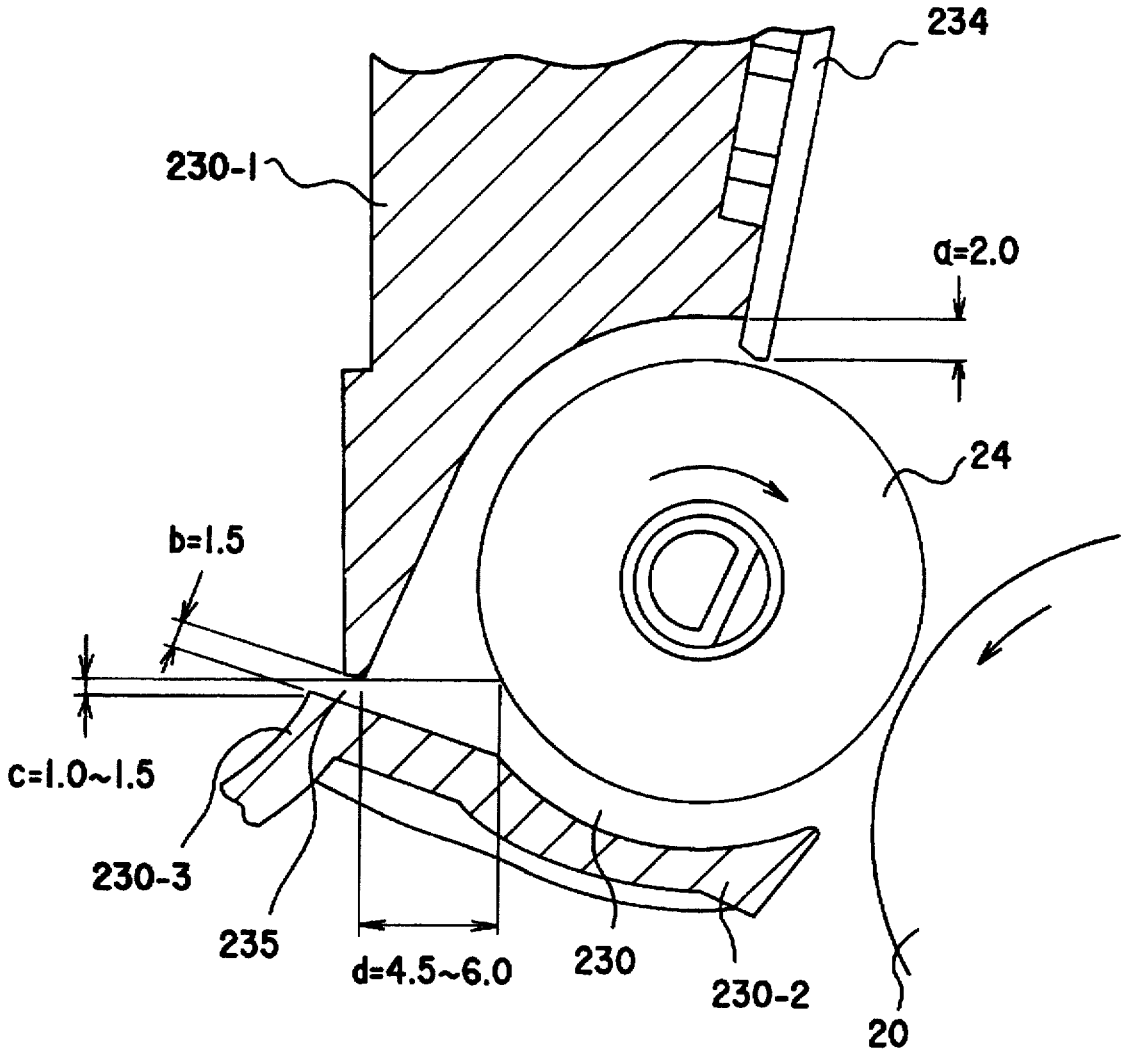
FIG. 6 is a cross section showing the essential portions of the developing unit in FIG. 5.
Figure 7:
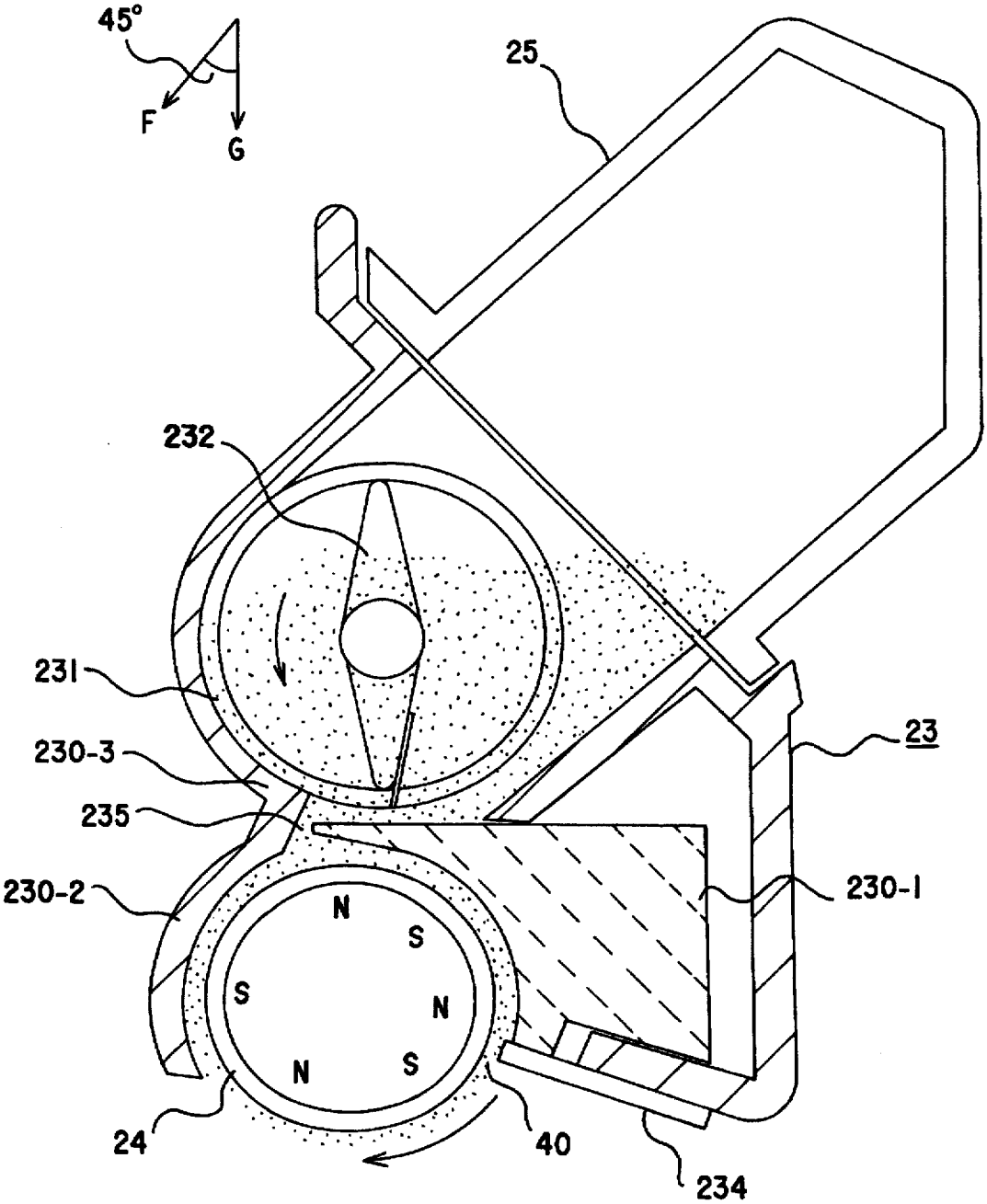
FIG. 7 s a diagram showing the developing unit in FIG. 5 in an upright position.
Figure 8A:
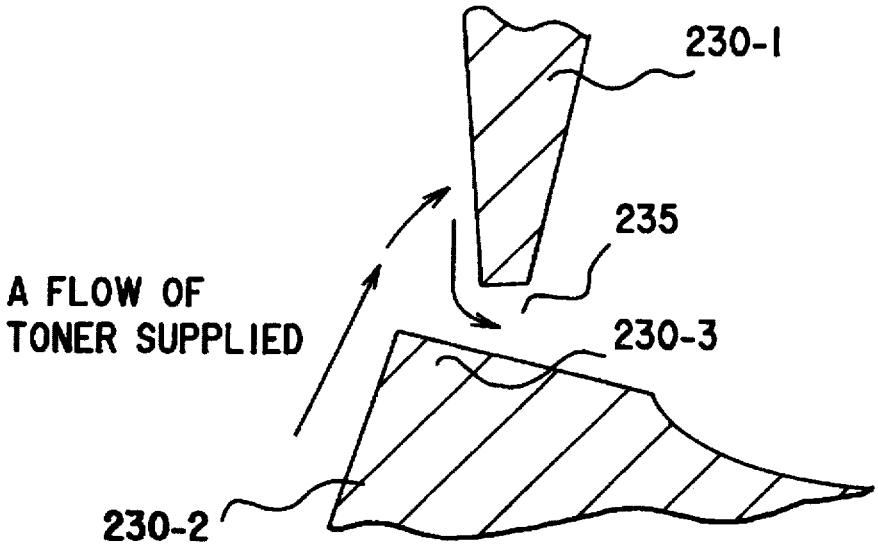
FIGS. 8A and 8B are diagrams for explaining the operation of the developing unit according to the present invention.
Figure 8B:
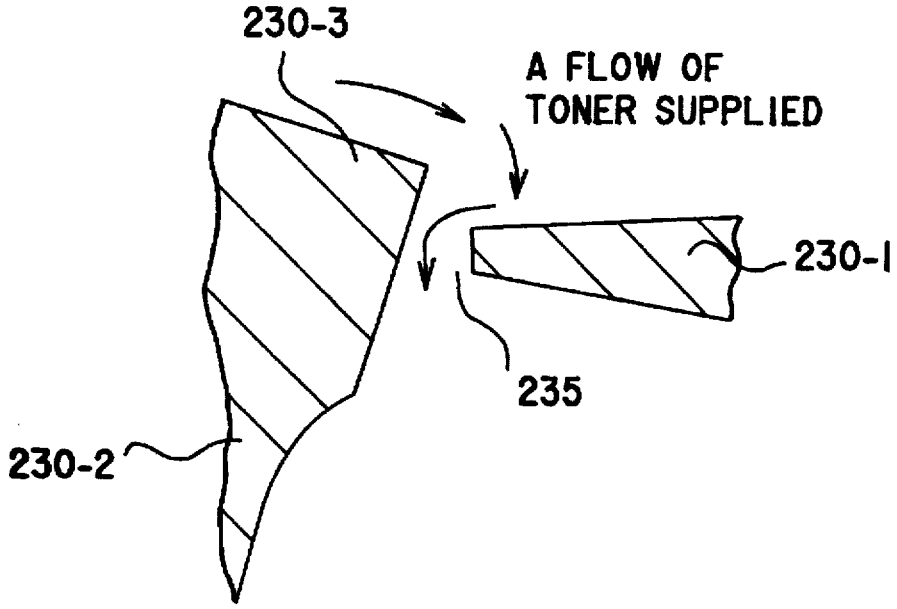
Figure 9:
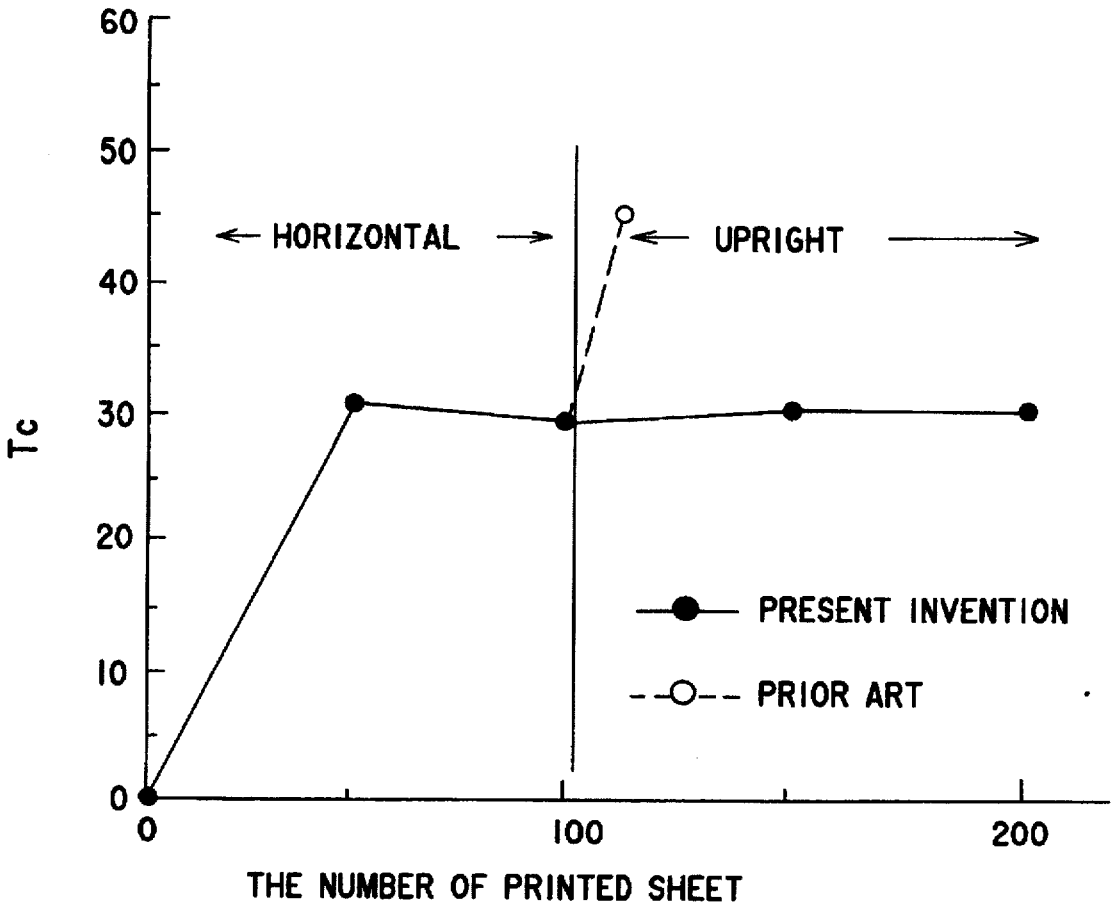
FIG. 9 is a characteristic chart of the image forming operation of the present invention.

FIG. 5 is a structural diagram of the developing unit in FIG. 2, FIG. 6 is a cross section showing the essential portions of the developing unit in FIG. 5, FIG. 7 is a diagram showing the developing unit in FIG. 5 in an upright position, FIGS. 8A and 8B are diagrams for explaining the toner supply operation, and FIG. 9 is a characteristic chart of the image forming operation of the present invention.

In FIG. 5, the developing rollers 24 are constituted of a magnetic roller, which has a metal sleeve 241 and a plurality of magnets 240 disposed inside the sleeve. The developing rollers 24 feed a magnetic developer (to be described later) by the rotation of the sleeve 241, with the magnets 240 secured inside the sleeve. The developing rollers 24 are 16 mm in diameter and rotate at a speed (75 mm/s) three times faster than the peripheral velocity of the photosensitive drum 20.

A developing room 230 is formed around the developing rollers 24. The developing room 230 is filled with a 1.5-component developer, which is a mixture of a magnetic carrier and magnetic toners. This developing room 230 is defined by an upper partition member 230-1 and a bottom 230-2, and has a constant volume.

When a constant amount of a magnetic carrier is supplied to the developing room 230, the amount of the magnetic toners in this room 230 also becomes constant. As the amount of the developer in the developing room 230 is constant, the toner density becomes constant when the used magnetic toners are supplemented from a toner hopper 231. This can eliminate the need to control the toner density. In other words, the toner density is automatically controlled within a predetermined range by supplementing the amount of the magnetic carrier, which is equivalent to the control point for the toner density, into the developing room 230.

Because the developer is always fully present around the developing rollers 24 in this developing room 230, even with the printer placed upright, the developer in the developing room 230 will not concentrate at some part, thus preventing insufficient supply of the developer to the developing rollers 24.

The magnetic carrier in a developer 40 is a magnetite carrier of an average particle size of 40 microns. The magnetic toners are polymerized toners of an average particle size of 7 microns. The polymerization toners have a uniform particle size and have a sharp particle distribution, so that adhesion between the sheet and the toner image on the photosensitive drum 20 becomes uniform in the transfer process. Accordingly, the electric field in the transfer section becomes uniform, thus improving the transfer efficiency more than the conventional pulverizing method. The transfer efficiency of the pulverized toners is 60 to 90% while the transfer efficient of the polymerization toners is 90% or above.

Although the proper toner density of the toners is 5 to 60% by weight, it was set to 30% by weight in this embodiment.

A doctor blade 234 serves to adjust the supply amount of the developer by the developing rollers 24 so that the developer will not be supplied excessively or insufficiently to the electrostatic latent image on the photosensitive drum 20. The adjustment is performed by the gap between the edge of the doctor blade 234 and the surfaces of the developing rollers 24; the gap is normally adjusted to about 0.1 to 1.0 mm.

The toner hopper 231 is filled only with magnetic toners and has a supply roller 232 inside. The rotation of the supply roller 232 supplies the toners to the developing room 230.

The toners supplied to the developing room 230 are stirred therein and rubbed against the carrier to be charged to a predetermined potential of a given polarity by the developer supplying force of the sleeves of the developing rollers 24, the magnetic force of the developing rollers 24 and the developer regulating performance of the doctor blade 234. In this embodiment, the toners are charged negatively to control the charging systems of the carrier and the toners.

Further, the gap between the partition member 230-1 and the developing rollers 24 at the upstream of the blade 234 is set smaller than the tips of the bristles of the magnetic brush formed on the developing rollers 24. In this example, the gap a is set to 2.0 mm as shown in FIG. 6. Accordingly, the magnetic brush on the developing rollers 24 is restricted by the partition member 230-1 and receives force by the rotation of the developing rollers 24. This increases the stirring of the developer in the developing room 230, ensuring a stable amount of toner charging even within a high toner-density range. This gap is uniformly set around the developing rollers 24, so that the same charging effect will be obtained regardless of the upright position or horizontal position of the printer.

A toner supply passage 235, which is defined by the distal end of the partition member 230-1 and the bottom 230-2, is provided between the toner hopper 231 and the developing room 230. The width b of the toner supply passage 235 is 1.5 mm as apparent from FIG. 6. The toners in the toner hopper 231 are supplied along the toner supply passage 235 to the developing room 230.

The bottom 230-2 that defines the developing room 230 has a projection 230-3 protruding from the toner hopper 231 in the toner supply passage 235. The bottom 230-2 has an inclined face extending upward from the side of the photosensitive drum 20. The gap c between the distal end of the projection 230-2 and the distal end of the partition member 230-1 is set to 1.0 to 1.5 mm as shown in FIG. 6. That is, the bottom 230-2 is inclined by this amount. In addition, the distance d between the distal end of the partition member 230-1 and the developing rollers 24 is set to 4.5 to 6.0 mm.

Next, the angles of both walls of the toner cartridge 25 and the toner hopper 231 are set to about 45 degrees with respect to the gravitational direction, ensuring the angle of the toner flow to 45 degrees. Even with the printer set upright, therefore, the toners will be supplied smoothly as will be described later.

The operation of this developing unit will be described below. FIG. 5 shows the state of the developing unit when the printer is set in a horizontal position, as shown in FIG. 3, with the angles of the walls of the toner cartridge 25 and the toner hopper 231 are set to about 45 degrees with respect to the gravitational direction. Therefore, the toners flow toward the bottom of the toner hopper 231 to be smoothly supplied to the supply roller 232.

In this horizontal position, the toners flow toward the bottom in the toner hopper 231 due to gravitation, so that the supply roller 232 scrapes off the toners at the bottom of the toner hopper 231. At this time, the toners lifted by the supply roller 232 temporarily abut on the partition member 230-1 by the projection 230-3 of the bottom 230-2 and then enter the toner supply passage 235, as shown in FIG. 8A. As a result, only the toners supplied by the toner supply roller 232 enter the toner supply passage 235. The toner abutting portion of the partition 230-1 serves as a buffer so that the force of the toner supply roller 232 will not directly influence the toner supply passage 235. This prevents excessive supply of the toners and allows just the amount of toners needed to be supplied to the developing room 230.

As the bottom 230-2 is tilted with respect to the rotational direction of the developing rollers 24 in this case, the magnetic brush of the developing rollers 24 after passing the photosensitive drum 20 and the carrier that has escaped the brush will not leak into toner hopper 231 along the toner supply passage 235 through the bottom 230-2. It is therefore possible to prevent the amount of the starter carrier in the developing room 230 from decreasing and accomplish stable image development with the 1.5-component developer.

In the state of the developing unit shown in FIG. 7 with the printer set upright as in FIG. 4, the angles of the walls of the toner cartridge 25 and toner hopper 231 are also set to about 45 degrees with respect to the gravitational direction. Even in this upright position, therefore, the toners can be smoothly supplied to the toner supply roller 231.

In consideration of the angle of repose, the proper angles of the walls of the toner cartridge 25 and toner hopper 231 would be about 45 degrees *+10 degrees with respect to the gravitational direction in order to feed the toners by the dead weight, and 45 degrees *+5 degrees, preferably, would produce good results.

At this time, the toners stay on the toner hopper side of the partition member 230-1 and will easily fall off the toner supply passage 235 into the developing room 230 as shown in FIG. 7. But, the projection 230-3 of the bottom 230-2 restricts the falling of the toners from the toner supply passage 235 as shown in FIG. 8B so that the toners would hardly drop. In other words, the supply of the toners is dependent on the rotational force of the toner supply roller 232.

As shown in FIG. 8B, the toners pressed by the toner supply roller 232 temporarily abut on the partition member 230-1 by the projection 230-3 of the bottom 230-2 and then enter the toner supply passage 235. As a result, only the toners supplied by the toner supply roller 232 enter the toner supply passage 235. The toner abutting portion of the partition 230-1 serves as a buffer so that the force of the toner supply roller 232 will not directly act to supply the toners. This prevents excessive supply of the toners and allows just the amount of toners needed to be supplied to the developing room 230.

This means that the performance of supplying the toners to the developing room 230 does not change, regardless of whether the printer is set in a horizontal position or in an upright position. Irrespective of whether the printer is set in a horizontal position or in an upright position, therefore, the toner density in the developing room 230 does not change, thus preventing a variation in image density.

With the printer in an upright position, the developer may drop from the developing unit 23. Since the magnetic two-component developer is used, however, the developer is held sticking on the developing rollers by the magnetic force so that the developer hardly drops even when the printer is set upright.

When the magnetic carrier and the magnetic toners are used, particularly, the carrier and toners are both held by the magnet rollers of the developing rollers 24, further preventing the developer from dropping and ensuring stable image development even when the printer is in an upright position.

FIG. 9 presents a characteristic diagram showing a change in toner density Tc when printing is executed first with the printer set in a horizontal position and then with the printer in an upright position.

First, the printer was set in a horizontal position, a predetermined amount of start carrier was placed in the developing room 230 of the developing unit 23 and the developing unit 23 was then activated to conduct printing. The toners are gradually supplied to the developing room 230 from the toner hopper 231, so that as the number of printouts increases, the toner density increases. When the developing room 230 become full with the carrier and toners, the toner density was 30% by weight. Thereafter, even when the number of printouts increased, the toner density did not change.

Under this condition, the printer was then set upright and printing was conducted. The toner density remained the same as that of the previous case of the printer in a horizontal position. When the printer having the structure disclosed in Japanese Unexamined Patent Publication No. 252686 is set upright, however, the toner density increased as indicated by a white circle. That is, the toner density changed and the image density changed between the horizontal position and the upright position. This proves the stable toner supply of the present invention. Regardless of whether the printer is set in a horizontal or upright position, images will be formed without a variation in image density. The present invention will therefore provide an image forming apparatus which can be set in a horizontal position as well as in an upright position with the same printing quality.

Figure 10:
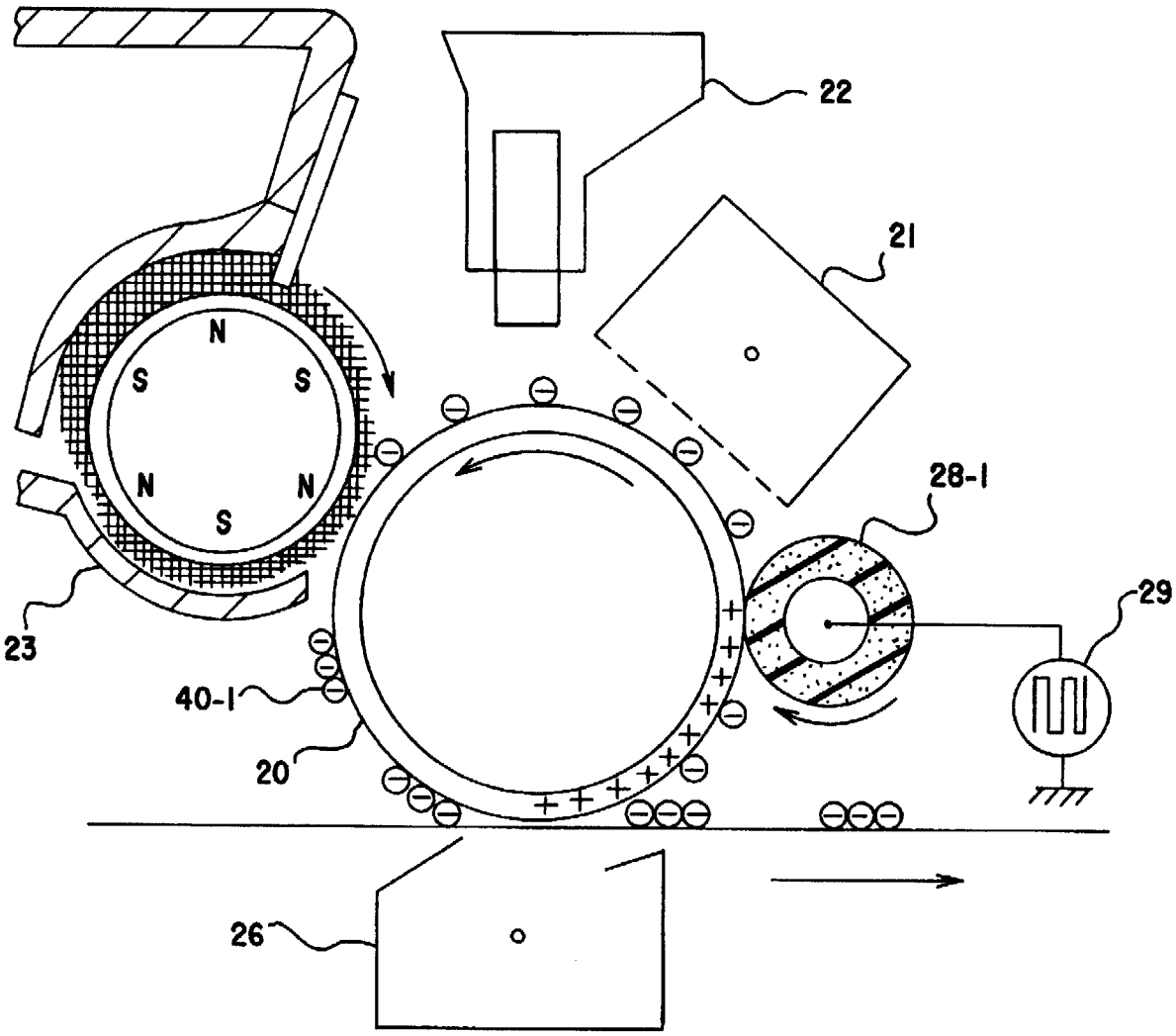
FIG. 10 is a structural diagram of the essential portions of a printing mechanism of the apparatus in FIG. 2.
Figure 11:
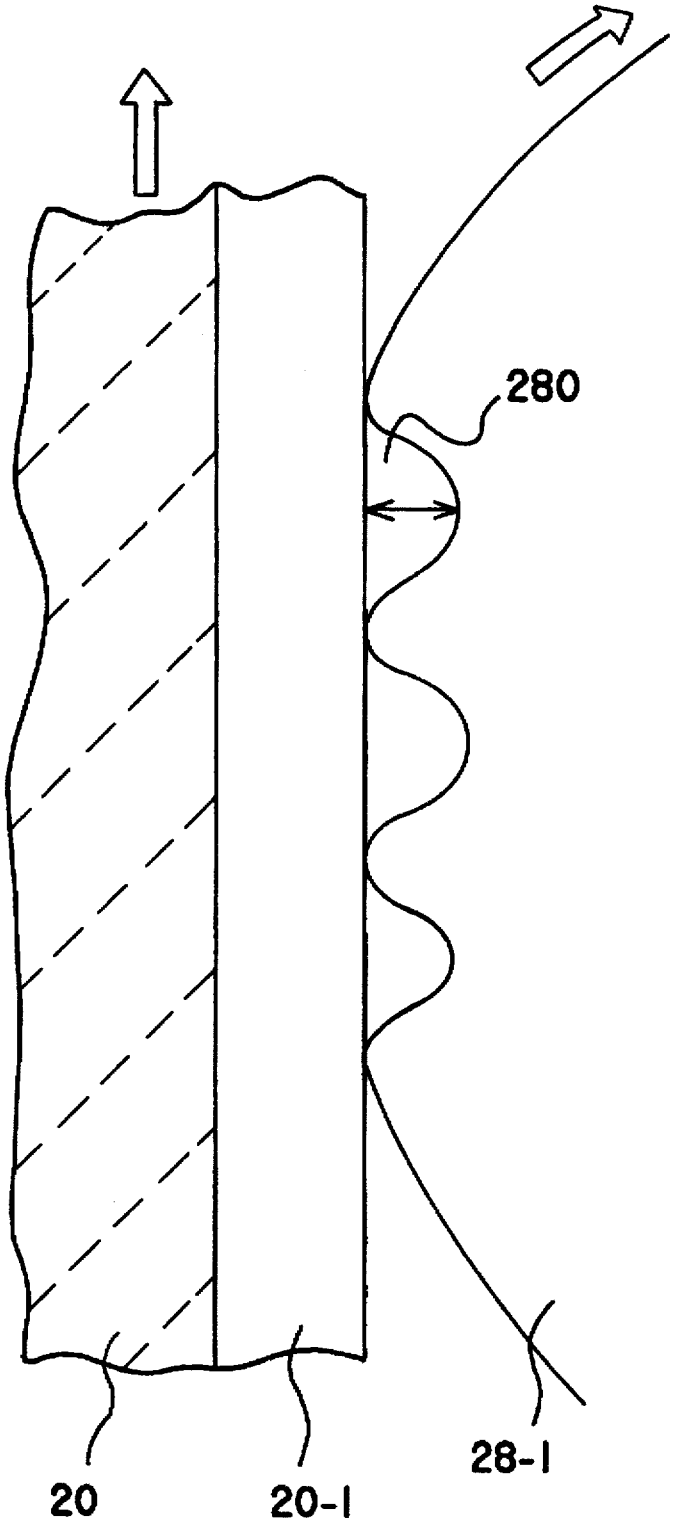
FIG. 11 is an operational explanatory diagram of an AC electric field created by a distribution roller shown in FIG. 10.
Figure 12:
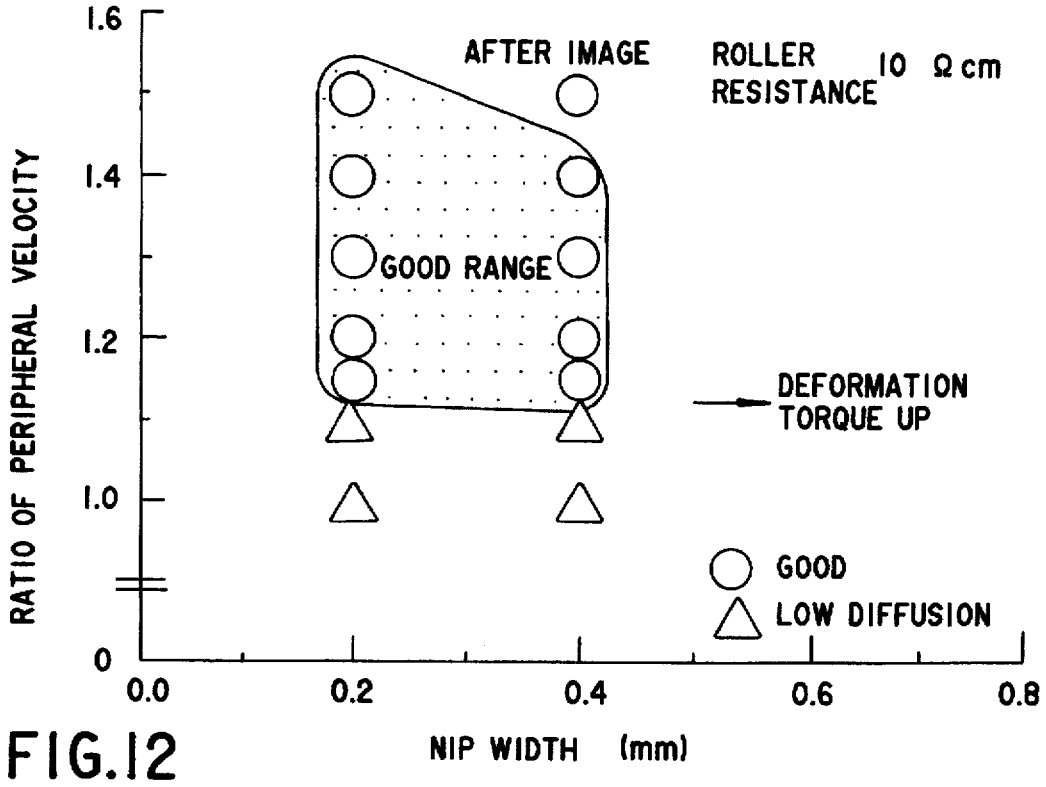
FIG. 12 is a characteristic chart showing the ratio of the peripheral velocity of the distribution roller in FIG. 10 to that of a photosensitive drum.
Figure 13:
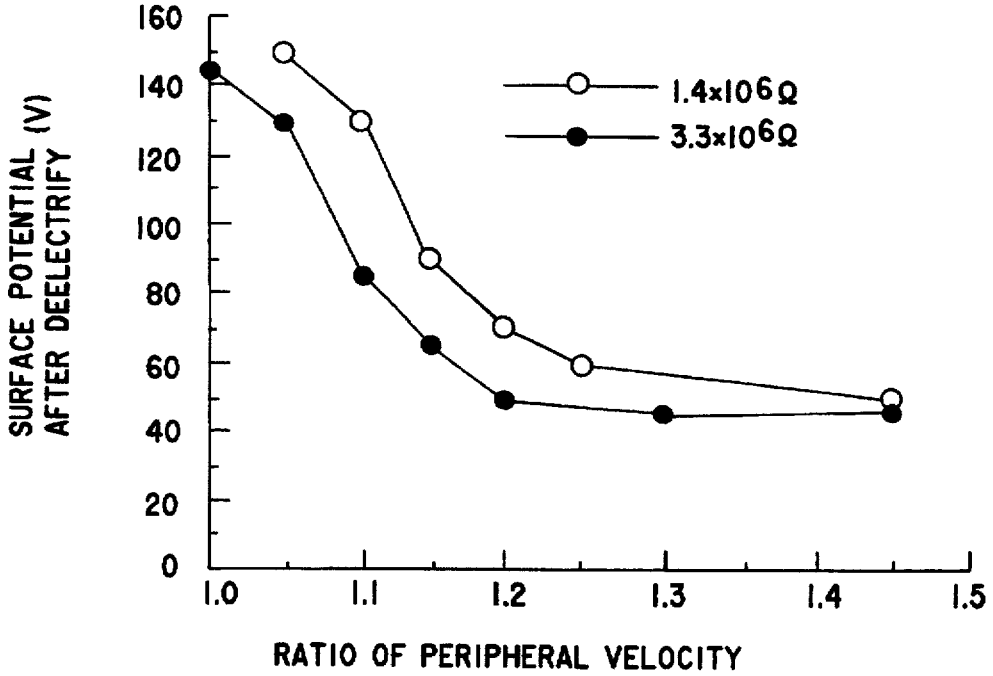
FIG. 13 is a characteristic chart showing the de-electrifying effect of the distribution roller in FIG. 10.
Figure 14:
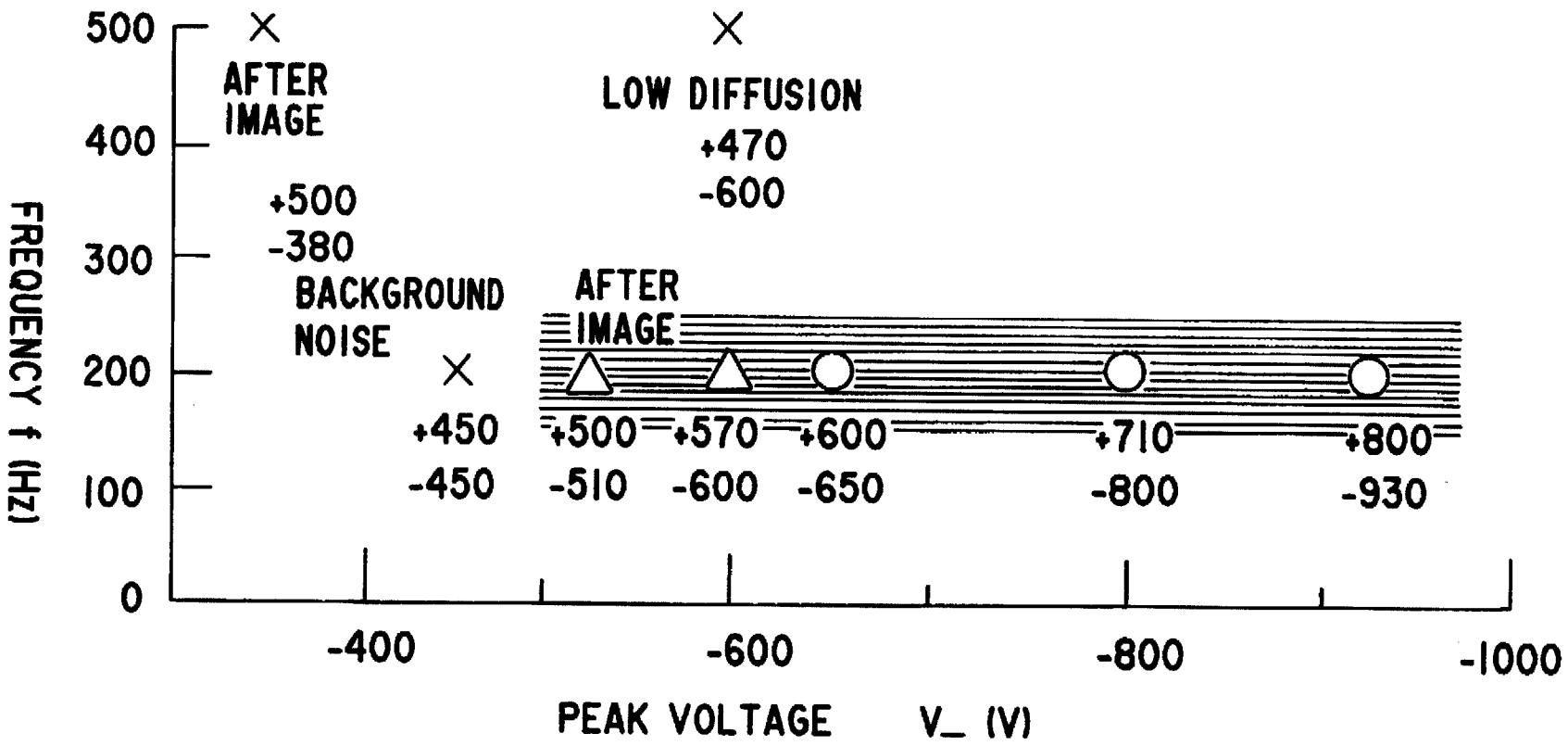
FIG. 14 is a characteristic chart showing an AC electric field created by the distribution roller in FIG. 10 at a normal temperature.
Figure 15A:
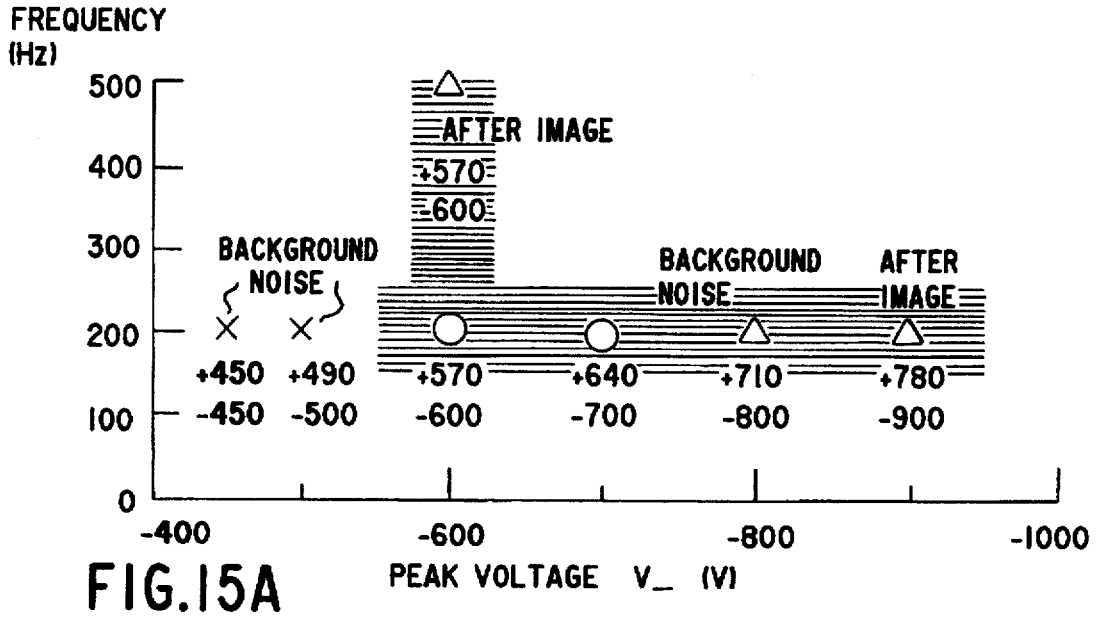
FIG. 15A is a characteristic chart showing an AC electric field created by the distribution roller in FIG. 10 at a low temperature and low humidity.
Figure 15B:
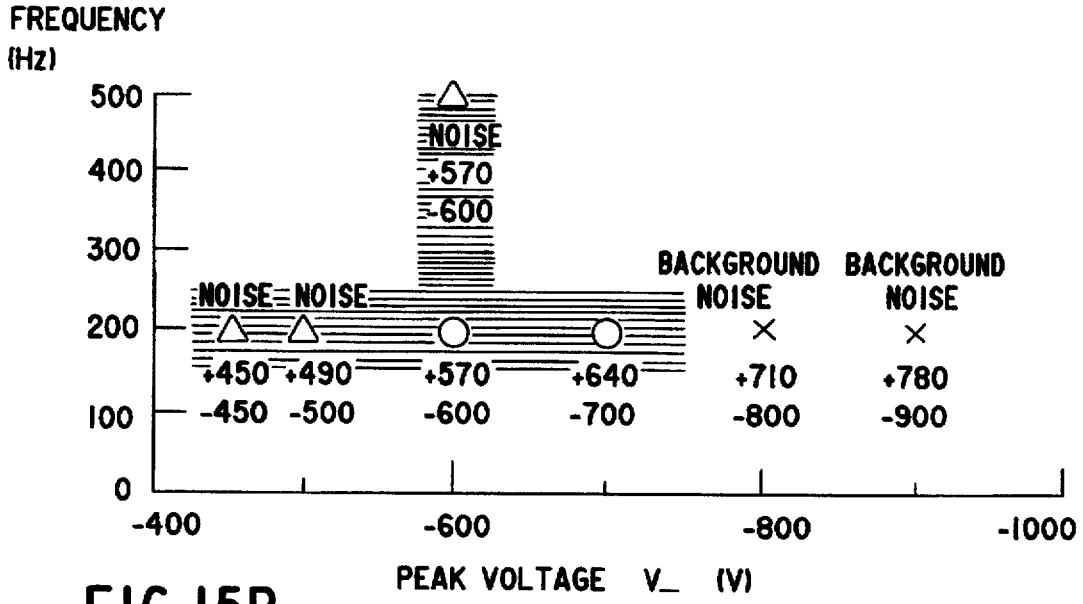
FIG. 15B is a characteristic chart showing an AC electric field created by the distribution roller in FIG. 10 at a high temperature and high humidity.

FIG. 10 is a structural diagram of the essential portions of one embodiment of the present invention, FIG. 11 is an operational explanatory diagram of an AC electric field according to the present invention, FIG. 12 is a characteristic chart showing the ratio of the peripheral velocity of the distribution roller to that of the photosensitive drum, FIG. 13 is a characteristic chart showing the de-electrifying effect of the distribution roller, FIG. 14 is a characteristic chart showing an AC electric field at a normal temperature, FIG. 15A is a characteristic chart showing an AC electric field at a low temperature and low humidity, and FIG. 15B is a characteristic chart showing an AC electric field at a high temperature and high humidity.

As shown in FIG. 10, the distribution member 28 is constituted of a conductive roller 28-1 which has a separate foam member. This roller 28-1 has a resistance of $10^6$ Ω and a hardness of 25 ° (Ascar C hardness). This roller 28-1 has a foam diameter of about 100 μm and has independent foam perforations.

The roller 28-1 contacts the photosensitive drum 20 with a nip amount of 0.3 mm at both ends of the roller. While the photosensitive drum 20 rotates at a peripheral velocity of 25 mm/sec, the roller 28-1 rotates at a peripheral velocity of 30 mm/sec, about 1.2 times faster than the speed of the drum 20. The rotational direction of the roller 28-1 is opposite to that of the photosensitive drum 20.

The AC power supply 29 applies a sine AC voltage of ±650 V to the roller 28-1 at a frequency of 200 Hz.

Consequently, the residual toners on the photosensitive drum 20 are moved back and forth in perforations 280 of the roller 28-1 by the AC electric field as shown in FIG. 11. The residual toners therefore properly move on the photosensitive drum 20, thereby reducing the amount of toners on the drum 20 per unit area. This facilitates the collection of the residual toners in the developing unit 23.

At the same time, the residual toners on the photosensitive drum 20 are swept by the edge portions of the perforations 280 of the rollers 28-1, making the toner movement easier.

Further, a minute discharge between the roller 28-1 and the photosensitive drum 20 starts in the perforations 280 of the roller 228-1, thereby charging the residual toners on the drum 20 to 0 or negatively. This prevents a positive residual image from being formed on the photosensitive drum 20.

As this roller 28-1 is a foam member and has a certain hardness, minute gaps can be secured between the roller 28-1 and the photosensitive drum 20 by the perforations 280 as shown in FIG. 11. The minute gaps where the residual toners move provide the necessary discharge gaps. It is desirable that the perforations 280 have a size of 50 to 150 μm with respect to the toner diameter of 7 μm. It is desirable that the resistance of the roller 28-1 be $10^4$ to $10^8$ Ω. If the Ascar C hardness is 30° or smaller, the necessary nip width can be obtained to secure the necessary gaps by the perforations 280.

As the peripheral velocity of the foam roller 28-1 is faster than that of the photosensitive drum 20 as shown in FIG. 12, the residual toners on the photosensitive drum 20 are mechanically swept by the edges of the perforations 280 of the roller 28-1. This mechanical toner distribution together with the electrical toner distribution will improve the effect of distributing the residual toners.

The desirable peripheral velocity of the roller 28-1 is about 1.1 to 1.5 times that of the photosensitive drum 20 as shown in FIGS. 12 and 13. With the peripheral velocity ratio smaller than 1.1, the toner distribution effect is small as shown in FIG. 12 and the de-electrifying effect is small as shown in FIG. 13. When the peripheral velocity ratio exceeds 1.5, background noise of the photosensitive drum 20 occurs as shown in FIG. 12. This is considered to have originated from the toners sticking on the roller. The proper nip depth of the roller to the photosensitive drum 20 was 0.2 mm to 0.4 mm as shown in FIG. 12.

As the foam roller 28-1 rotates in the opposite direction (upward in FIG. 10) to that of the photosensitive drum 20, the toners even if scattered will not fall down on an underlying sheet.

Further, the perforations in the foam roller 28-1 are independent from one another, the roller 28-1 will not be clogged with paper powder. Accordingly, the resistance of the foam roller 28-1 increases to prevent the reduction of the effective voltage by an AC electric field. It is also possible to prevent the hardness of the foam roller 28-1 from changing.

The characteristic of the AC electric field will now be discussed. As shown in FIG. 14, the peak voltage of the AC voltage should be −500 V or above at a normal temperature and normal humidity, and the proper frequency is 200 Hz ±50 Hz. At a low temperature and low humidity (5° C., 10% RH), as shown in FIG. 15A, the proper peak voltage of the AC voltage is about −550 to −750 V and the proper frequency is 200 Hz±50 Hz. At a high temperature and high humidity (35° C., 80% RH), as shown in FIG. 15B, the proper peak voltage of the AC voltage is about −550 to −700 V and the proper frequency is 200 Hz±50 Hz. From the above, the proper peak voltage is −650 V±100 V, and the proper frequency is 200 Hz±50 Hz.

As the waveform of the AC voltage is affected by the area of the current waveform, a sine waveform and a rectangular waveform are desirable.

As the foam roller 28-1 is rotated in the opposite direction (upward in FIG. 10) to that of the photosensitive drum 20, the toners even if scattered will not fall down on a sheet so that the sheet will not be stained. As the peripheral velocity of the foam roller 28-1 is set to 1.1 to 1.5 times faster than that of the photosensitive drum 20, the foam body will exhibit the mechanical toner-distribution effect.

Further, since the frequency of the AC electric field to be applied to the distribution member 28 is set to 150 Hz or above, the residual toners can be moved. Furthermore, the frequency of this AC electric field does not exceed 250 Hz because above this level the frequency is too fast to move the residual toners.

Figure 16:
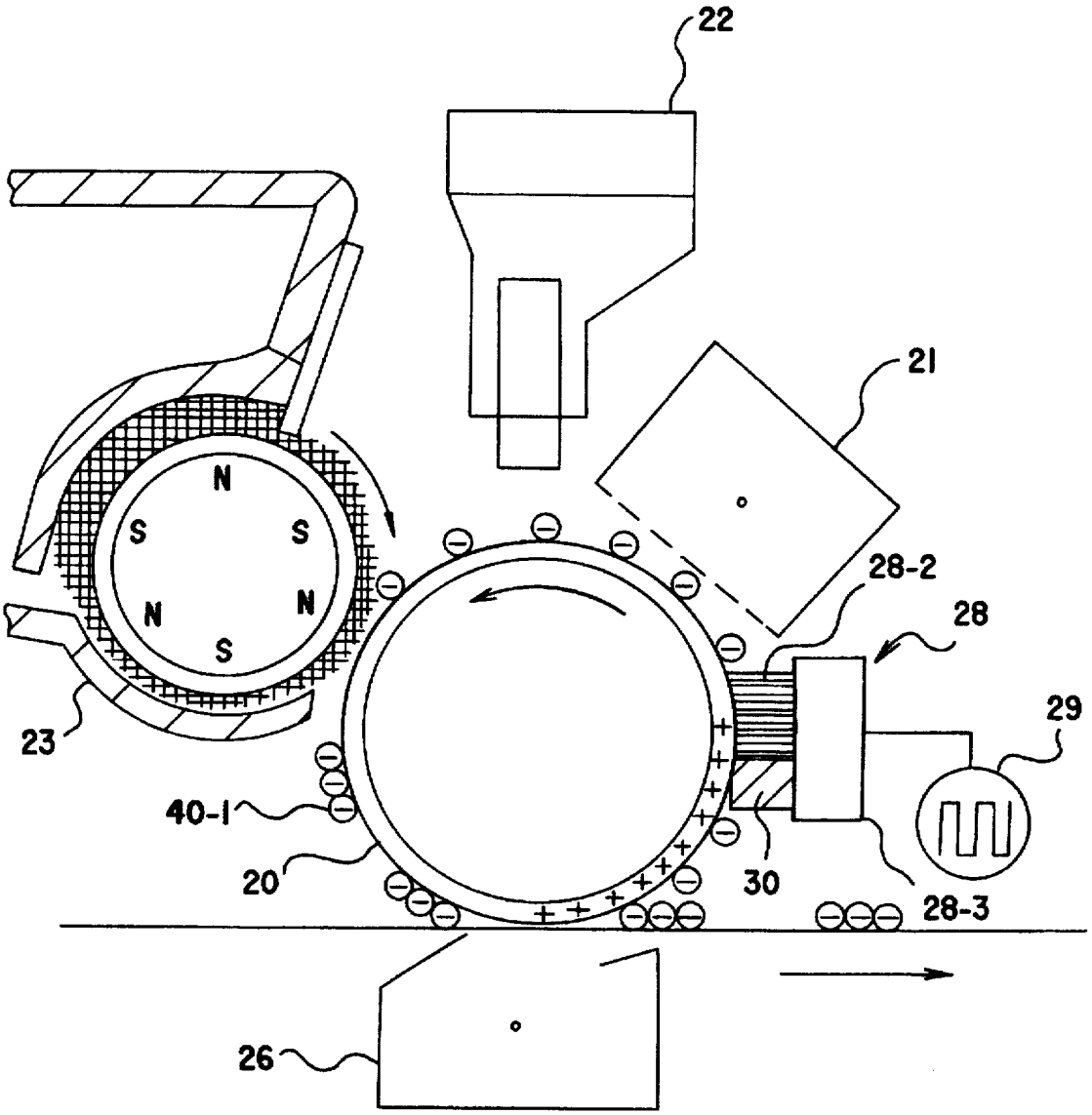
FIG. 16 is an explanatory diagram of a modification of a distribution member according to the present invention.

FIG. 16 is an explanatory diagram of a modification of the distribution member according to the present invention.

In this modification, a stationary type brush 28-2 is used for the distribution member 28 as shown in FIG. 16. This brush 28-2 has a conductive brush implanted in a rectangular support base 28-3 having a width of 7 mm. The nip depth of the conductive brush 28-2 to the photosensitive drum 20 is set to 0.9 to 1.3 mm.

The aforementioned AC power supply 29 is connected to this conductive brush 28-2. Therefore, the conductive brush 28-2 performs the above-described reciprocal movement of the residual toners and de-electrification.

A paper-powder removing brush 30 is provided upstream of the distribution brush 28-2 to remove paper powder off the photosensitive drum 20. This brush 30 is made of an insulating brush (e.g., "Vesron": trade name), The following is the reason why this paper-powder removing brush 30 is provided. When paper powder penetrates the distribution brush 28-2, the resistance of the brush 28-2 increases, reducing the effective voltage. As a result, the de-electrifying effect by the discharging of the brush 28-2 and the toner distribution effect by the applied AC voltage are reduced. This produces an afterimage.

The paper-powder removing brush 30 is thus provided upstream of the distribution brush 28-2 to eliminate paper powder at the preceding stage of the distribution brush 28-2, thereby preventing paper powder from sticking on the brush 28-2. This paper-powder removing member 30 will also be effective if adapted for the aforementioned distribution roller 28-1.

Figure 17A:
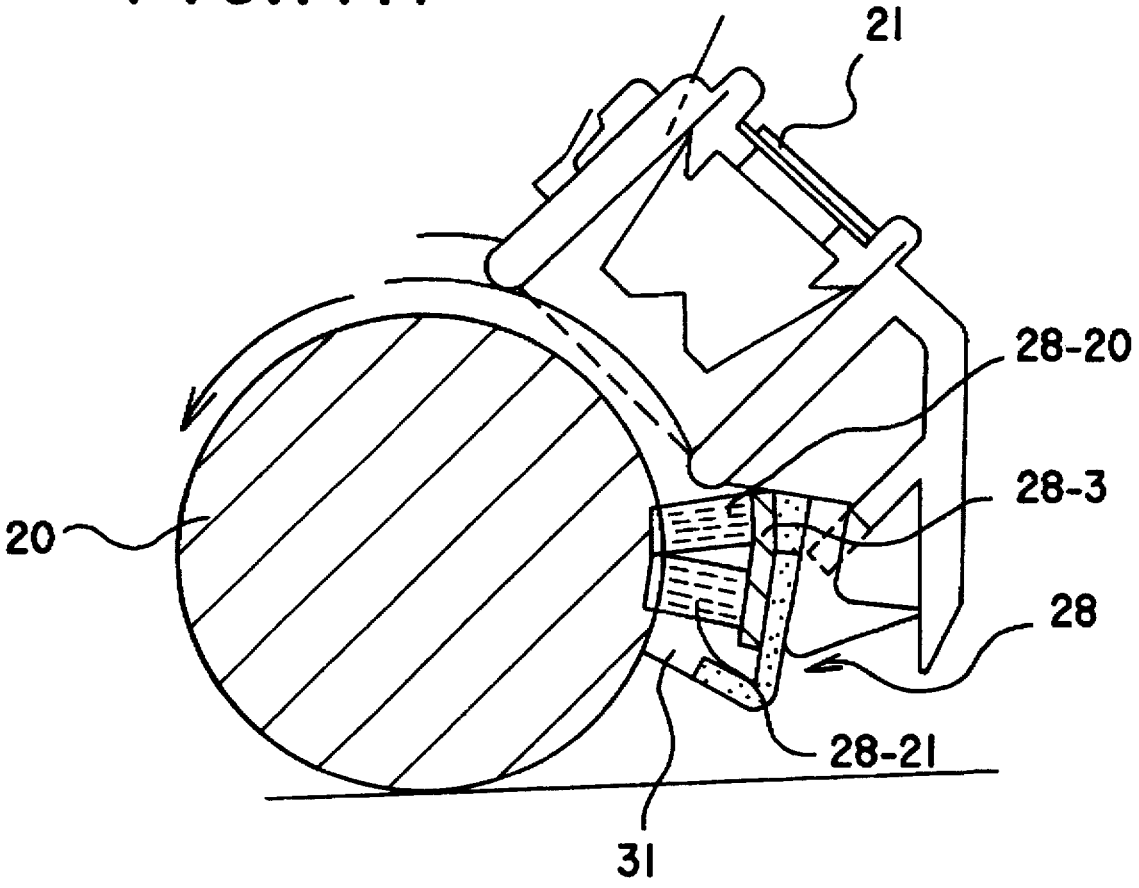
FIGS. 17A and 17B are explanatory diagrams showing a modification of the distribution brush in FIG. 16.
Figure 17B:
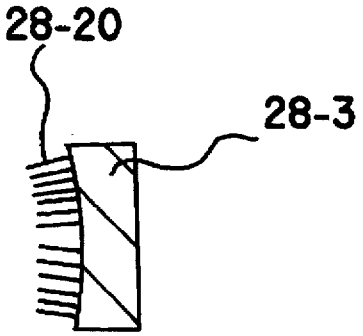

FIGS. 17A and 17B are explanatory diagrams showing a modification of the distribution brush in FIG. 16.

As shown in FIG. 17A, the brush base 28-3 has a bending shape of a bracket with conductive brushes 28-20 and 28-21.

This following is the reason for the employing this particular design. To maximize the effect of the distribution brush, the brush should have a certain range of a nip depth over the entire brush width. If the nip depth is shallow, the de-electrifying effect by the conductive brush is reduced, so that an afterimage is easily formed. If the nip depth is too deep, on the other hand, the effect of popping the residual toners over the photosensitive drum 20 is reduced. This allows some toners to escape the sweeping and to stay much within the brush, thus reducing the toner distribution effect.

If the photosensitive drum 20 of a small diameter is used to make the image forming apparatus compact, the nip depth at the peripheral portions becomes shallow and the nip depth at the center becomes deep to ensure a sufficient brush width because of the small radius of curvature. The substantially effective brush width therefore becomes narrower. If the nip depth is set within a certain range, the brush width becomes narrow and the desired de-electrification and toner distribution effects cannot be expected.

In view of the above, the bending-shaped support base 28-3 is provided and two conductive brushes 28-20 and 28-21, which are 2.5 mm wide and have different mounting angles, are provided at the base 28-3. The nip depth at the center of each conductive brush 28-20 or 28-21 is set to 1.1 mm. In this case, the nip depth satisfies an error specification of ±0.2 mm over the entire brush width. The effective brush width therefore becomes a total of 5 mm, which is sufficient to exhibit the desired performance.

As shown in FIG. 17A, a fall stopping member 31 is provided at the bottom portion of the brush 28-21. The fall stopping member 31 will receive falling toners which have been repulsed by the brushes 28-20 and 28-21, thus preventing the toners from falling down on a sheet.

FIG. 17B illustrates another example of the support base 28-3. In this example, the support base 28-3 has an arc shape. The arcuate base 28-3 has the conductive brush 28-20 implanted therein over an arcuate width of 5 mm. The nip depth of 1.1 mm is secured over the whole brush length to achieve sufficient de-electrification and toner distribution effects. The brushes would overlap each other at the center portion of the arc, a slight gap should be provided between the brushes. In this example, a gap of 1 mm is provided.

As the support block for the conductive brush is designed to match the shape of the latent image carrier, the nip depth of the conductive brush can be made uniform. Accordingly, toner distribution and de-electrifying effects by the stable AC electric field can be achieved over the entire area where the conductive brush contacts.

Figure 18A:
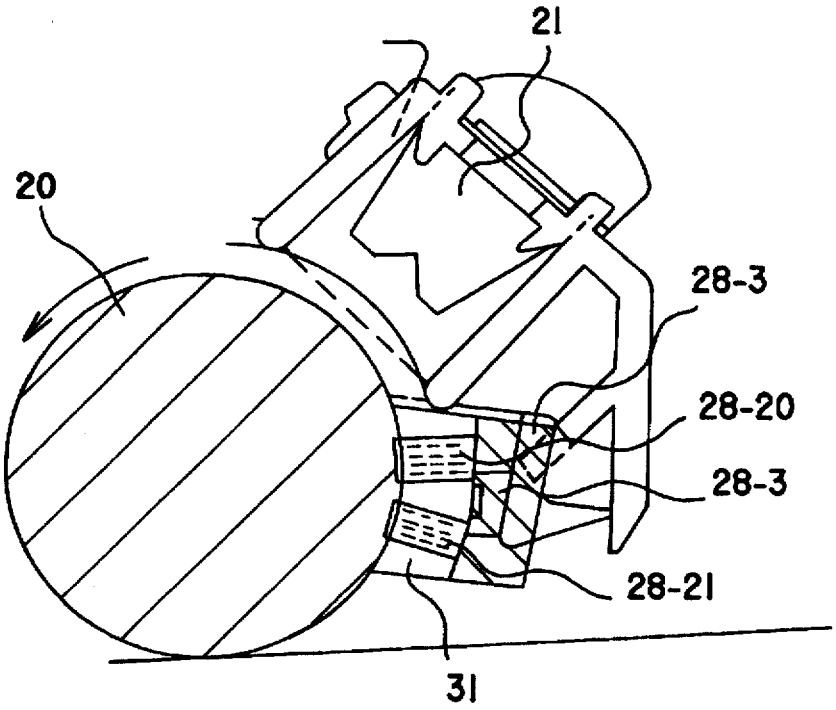
FIGS. 18A and 18B are explanatory diagrams showing another modification of the distribution brush in FIG. 16.
Figure 18B:
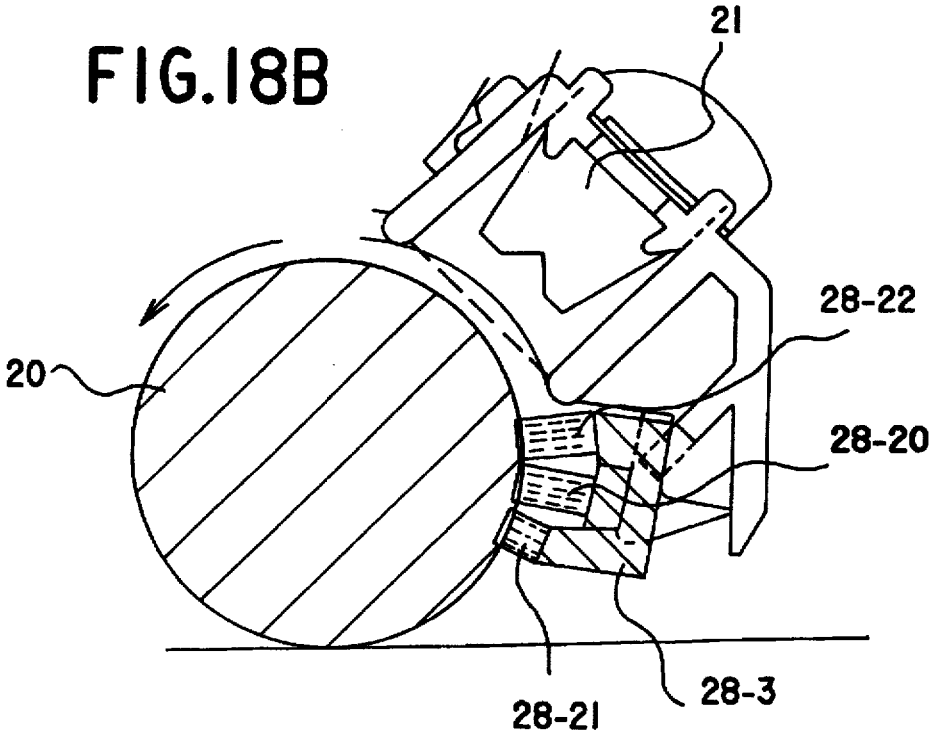

FIGS. 18A and 18B are explanatory diagrams showing another modification of the distribution brush.

This modification is designed for the following purpose. The effect of the distribution brush is determined by the width, density, electric resistance and thickness of the brush. If the electric resistance is set low in consideration of an increase in resistance at a low temperature and low humidity, the resistance further drops at a high temperature and high humidity. At a high temperature and high humidity, therefore, the distribution effect will be reduced. If the brush density is increased, the de-electrifying effect is improved while the high brush density makes it difficult to vibrate the toners, thus also reducing the distribution effect. If the nip depth of the brush is increased, the de-electrifying effect increases but the distribution effect decreases and another problem like toner filming on the photosensitive drum is likely to arise also.

A plurality of distribution brushes 28-2 are provided for different intended functions. In the example of FIG. 18A, two type of distribution brushes 28-20 and 28-21 are implanted in the support base 28-3. The upstream distribution brush 28-21 has a nip depth of 0.5 mm and a brush density of 60000 F/inch2. The downstream distribution brush 28-20 has a nip depth of 1.5 mm and a brush density of 100000 F/inch2.

Accordingly, while the upstream brush 28-21 exhibits a small de-electrifying effect, it will impart large force to move the toners so that a good distribution effect can be expected. The downstream brush 28-20 exhibits a good effect of eliminating the residual charges off the photosensitive drum 20 by the discharging from the brush 28-20.

In the example of FIG. 18B, the support base 28-3 is provided with three type of distribution brushes 28-20, 28-22 and 28-23. The distribution brush 28-22, located on the most downstream side, has a nip depth of 1.5 mm, a brush density of 100000 F/inch2 and an electric resistance of 105 *O lower by one factor than the other conductive brushes. The middle distribution brush 28-20 has a nip depth of 0.5 mm and a brush density of 60000 F/inch2. The distribution brush 28-21, located on the most upstream side, has a nip depth of 1.5 mm and a brush density of 100000 F/inch2.

It can be expected that the lowest conductive brush 28-22 will exhibit a de-electrifying effect particularly at a low temperature and low humidity. Accordingly, the last brush 28-22 can de-electrify the portion which cannot be de-electrified by the preceding two brushes 28-20 and 28-21.

In the example with three brushes shown in FIG. 18B, an offset voltage of −200 V is applied to the lowest conductive brush 28-22 at the lowest frequency of 200 Hz. This improves the distribution effect. A normal offset voltage of 0 V having a frequency of 250 Hz is applied to the middle conductive brush 28-20. A normal offset voltage of 0 V having a frequency of 300 Hz is applied to the uppermost conductive brush 28-21. Accordingly, the reduction of the distribution effect at a low temperature and low humidity can be prevented at the downstream side. The peak voltage is 550 Vp-p for all the three conductive brushes 28-20 to 28-22.

As a plurality of conductive brushes having different physical properties are provided, the distribution effect and the de-electrifying effect can be separately exhibited.

As different types of AC electric fields are applied to those conductive brushes, the distribution effect and de-electrifying effect can stably be accomplished at a low temperature and low humidity as well as at a high temperature and high humidity.

Figure 19A:
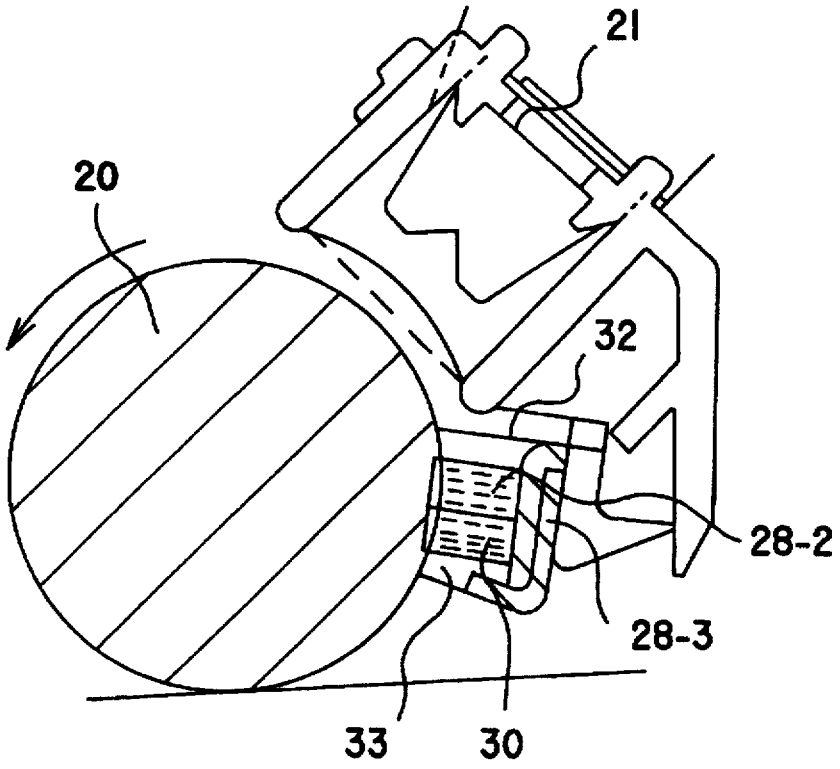
FIGS. 19A and 19B are explanatory diagrams showing a spare distribution member adapted for the distribution brush in FIG. 16.
Figure 19B:
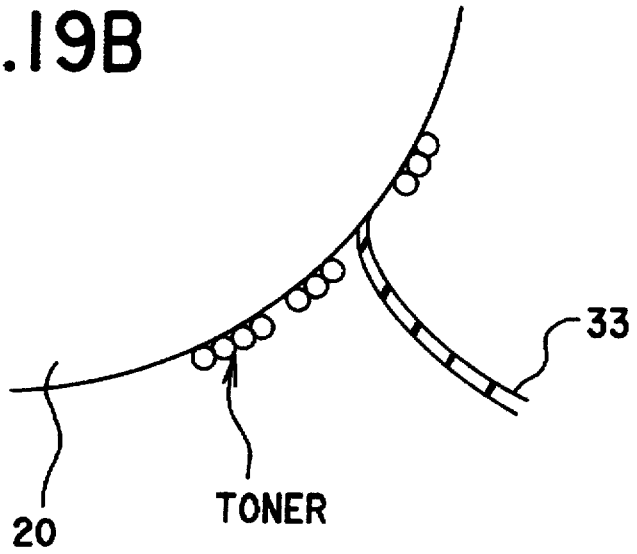

FIGS. 19A and 19B are explanatory diagrams of a spare distribution member.

In this example, a spare distribution member 33, which contacts the photosensitive drum 20 with pressure high enough not to scrape the toners off, is provided at upstream of the paper-powder removing brush 30. This modification is designed for the following purpose. When the transfer efficiency drops or immediately after jamming occurs, the amount of the residual toners on the photosensitive drum 20 increases drastically. At this time, the distribution member 28-2 alone may not be able to fully distribute the residual toners. In this case, the toner collection by the developing unit 23 cannot follow up the increasing toners which will become an afterimage, resulting in a poor image quality.

To prevent this undesirable phenomenon, the spare distribution member 33 is provided, as shown in FIG. 19A. As shown in FIG. 19B, this spare distribution member 33 contacts the residual toners on the photosensitive drum 20 to weaken the mechanical adhesive force of the residual toners to the photosensitive drum 20. Accordingly, this spare distribution member 33 effectively assists the distribution brush 28-2 to distribute the residual toners.

Even when a large amount of residual toners are generated, the toners' adhesive force is weakened when the toners pass the spare distribution member 33, thus providing an image without an afterimage. At the same time, the spare distribution member 33 prevents the residual toners from falling down onto the sheet feeding path even if some of the residual toners are scattered when contacting the distribution member 28-2.

It is desirable that the spare distribution member 33 be made of a rubber material which is soft enough not to damage the photosensitive drum 20. An example of such a material is "Vancoran" (trade name). The spare distribution member 33 is designed so that when the distribution member 33 is pressed against the photosensitive drum 20, its distal end bites into the photosensitive drum 20 on a trail.

Reference numeral "32" is a toner scatter preventing member, which is so provided as not to come in contact with the photosensitive drum 20. This member 32 seals the distribution member 28-2 so that the toners, scattered by the distribution member 28-2, will be prevented from sticking on the precharger 21.

As the elastic member 33 is provided on the upstream side, the auxiliary distribution effect can be achieved. Accordingly, the distribution effect by the m28-2 can be accomplished better. The toner scatter preventing member 32 prevents the residual toners from sticking on the precharger 21 even if scattered by the action of the distribution member 28-2.

Figure 20A:
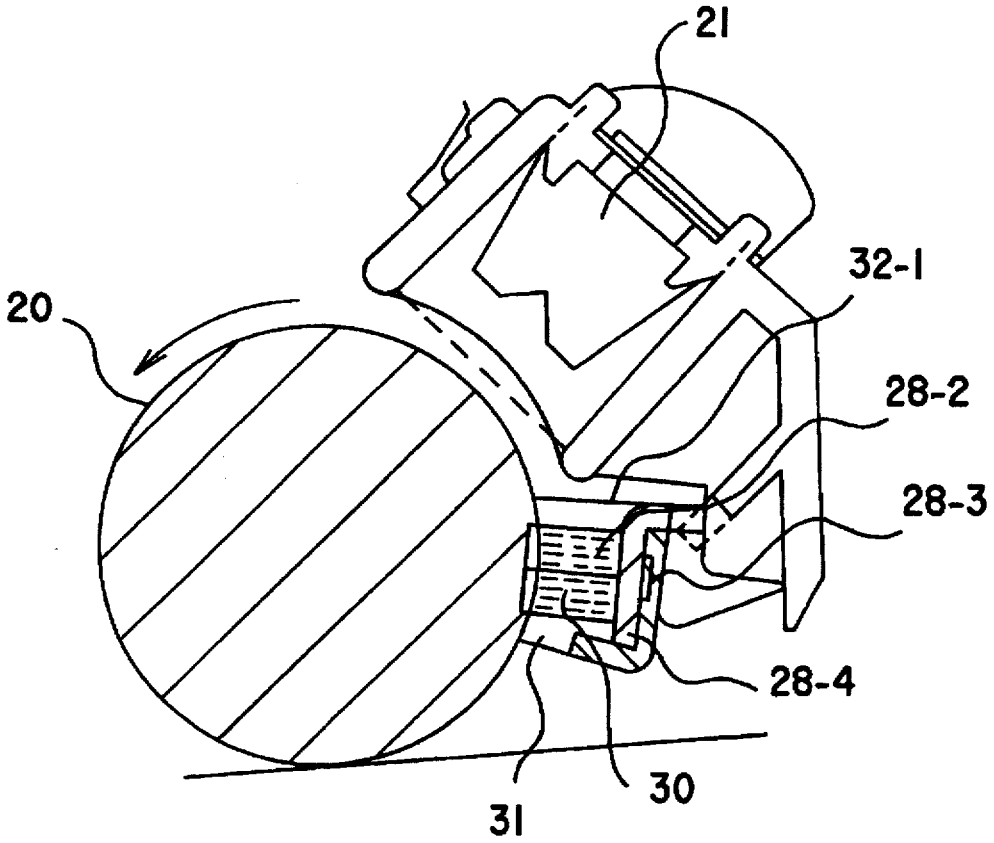
FIGS. 20A and 20B are explanatory diagrams showing a toner-scattering preventing member adapted for the distribution brush in FIG. 16.
Figure 20B:
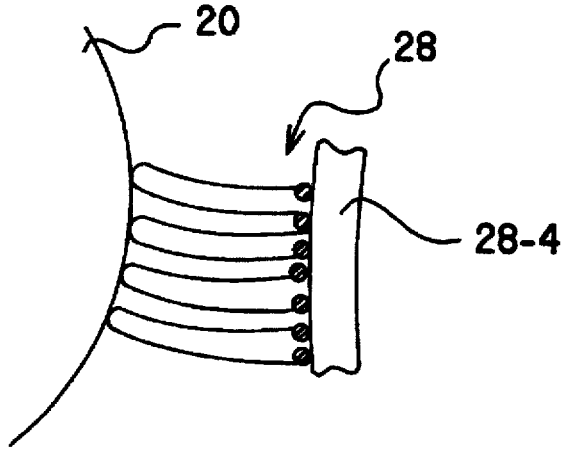

FIGS. 20A and 20B are explanatory diagrams of the toner scatter preventing member.

As shown in FIG. 20A, a toner scatter preventing member 32-1 is provided on the precharger (21) side (downstream side) of the distribution brush 28-2. Further, a magnetic member 28-4 is provided on the support base 28-3.

This modification is designed for the following purpose. The distribution brush 28-2 distributes the residual toners on the photosensitive drum 20, and de-electrifies the photosensitive drum 20. Thus, the toners moved off by the AC electric field return on the photosensitive drum 20. If weakly-charged toners or uncharged toners are present, however, those toners do not return on the photosensitive drum 20 and stay between the bristles of the brush 28-2 or escape the brush 28-2. As a result, those toners are scattered to the distal end of the brush 28-2 to reduce the distribution effect and de-electrifying effect of the distribution brush 28-2. In addition, the scattered toners will contaminate the precharger 21.

To cope with the above situation, first, the seal member 32-1 with a magnetic property is provided at downstream of the distribution brush 28-2. The proper material for this seal member 32-1 would be a film made of a rubber material containing magnetic particles. The seal member 32-1 magnetically attracts the magnetic toners that are scattering toward the precharger 21 to prevent the toner scattering.

Secondly, the support base 28-3 is provided with the magnetic member 28-4. As shown in FIG. 20B, the magnetic force generated from this base 28-3 attracts the weakly-charged toners and uncharged toners which are floating between the bristles of the brush 28-2. The density of the brush 28-2 increases when the distal end portion contacts the photosensitive drum 20, and the resistance of the brush 28-2 does not increase much unless the toners stick all over the brush. Even if the toners stay on the base 28-3, therefore, the effects of the brush 28-2 are not influenced.

Figure 21:
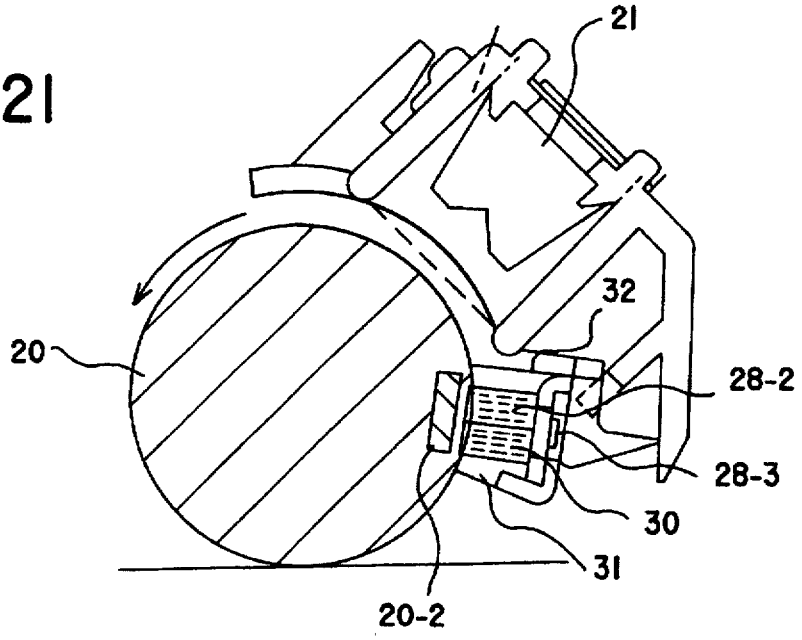
FIG. 21 is an explanatory diagram of the toner-scattering preventing member in FIG. 20A.

FIG. 21 is an explanatory diagram of a modification of the toner scatter preventing member.

In this modification, a magnetic member 20-2 is provided inside the photosensitive drum 20, facing the distribution member 28-2 and the paper-powder removing member 28-3. This design causes the weakly-charged toners and uncharged toners, which would be scattered, to return onto the photosensitive drum 20 by the magnetic force. This achieves the same effect of lifting the toners up and then returning them on the drum as the one produced by an AC electric field. Accordingly, the weakly-charged toners and uncharged toners will be prevented from scattering and will be collected by the developing unit 23.

Figure 22A:
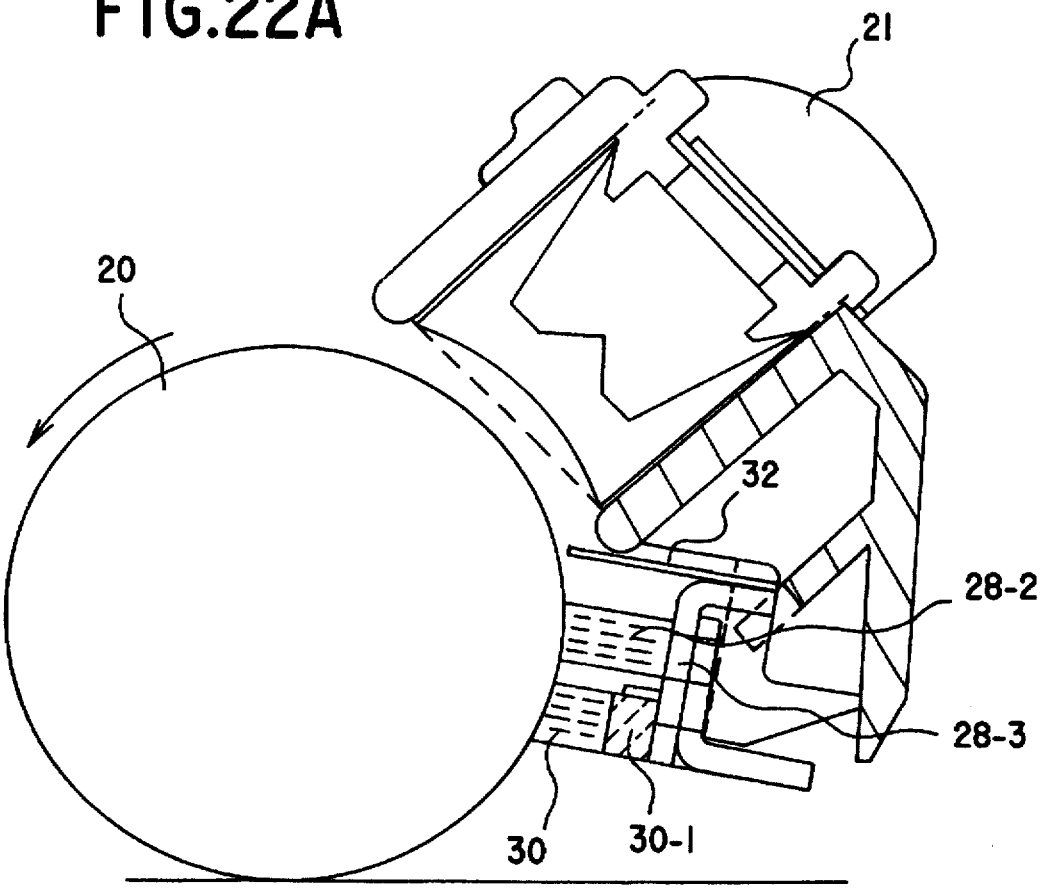
FIGS. 22A and 22B are explanatory diagrams showing a cleaning mechanism for a paper-powder removing brush, which is adapted for the distribution brush in FIG. 16.
Figure 22B:
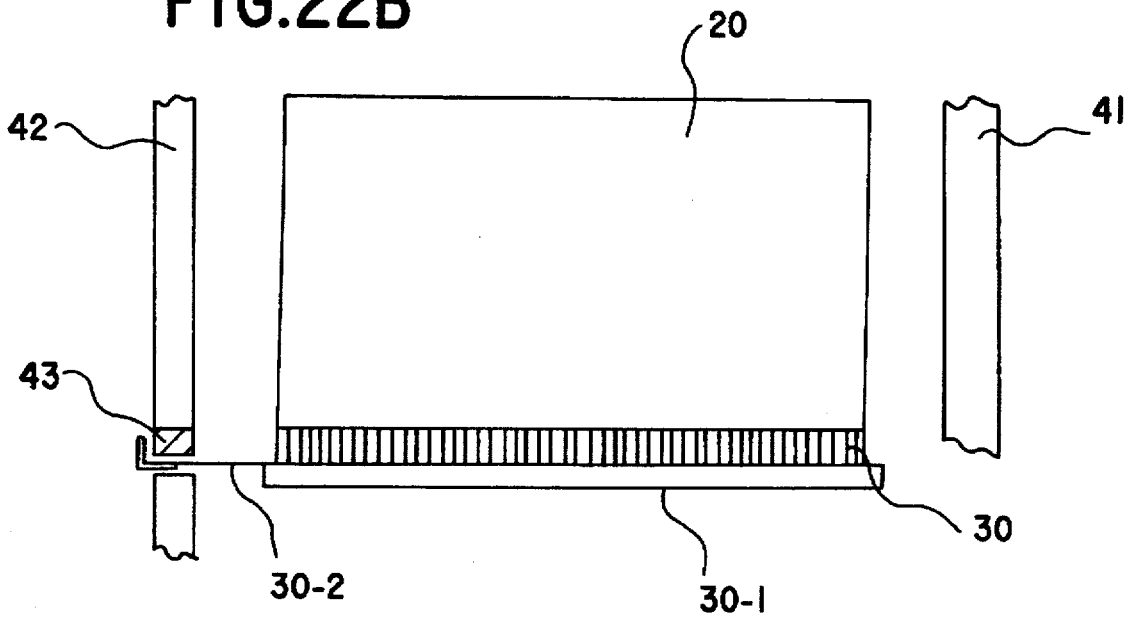

FIGS. 22A and 22B are explanatory diagrams showing a cleaning mechanism for a paper-powder removing brush.

The paper-powder removing effect of the paper-powder removing brush 30 decreases when more than a certain amount of paper powder is accumulated in the brush 30, as has already been explained with reference to FIG. 16. If the paper powder removed by this brush 30 is left untouched, the paper powder reacts with water or ozone in the air, so that drum filming may occur. It is therefore necessary to employ a mechanism for cleaning paper powder sticking on the paper-powder removing brush 30.

In this modification, the paper-powder removing brush 30 is supported on the support base 30-1 as shown in FIG. 22A. As shown in FIG. 22B, this support base 30-1 is provided with a handle 30-2. One of frames 41 and 42 of the apparatus, namely, the frame 42, has a drawer provided in its side. Felt (cleaning member) 43 is implanted in that side of the drawer where the paper-powder removing brush 30 contacts.

As the user holds the handle 30-2 and pulls out the paper-powder removing brush 30 leftward in FIG. 22B, the paper-powder removing brush 30 with paper powder sticking thereon is rubbed against the felt 43, cleaning off the paper powder. After the cleaning, the user replaces the paper-powder removing brush 30 back.

The paper powder which affects the function of the distribution brush can therefore be cleaned off easily with a simple structure.

Figure 23:
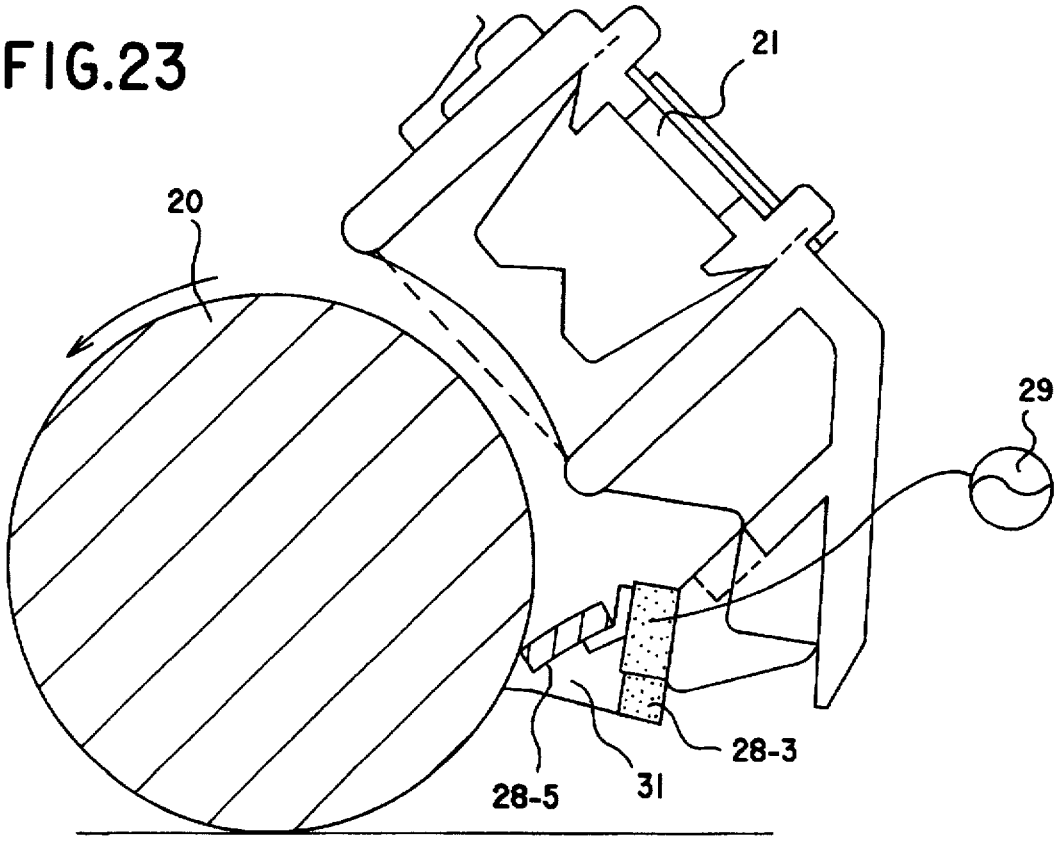
FIG. 23 is an explanatory diagram of another modification of a distribution member according to the present invention.
Figure 24:
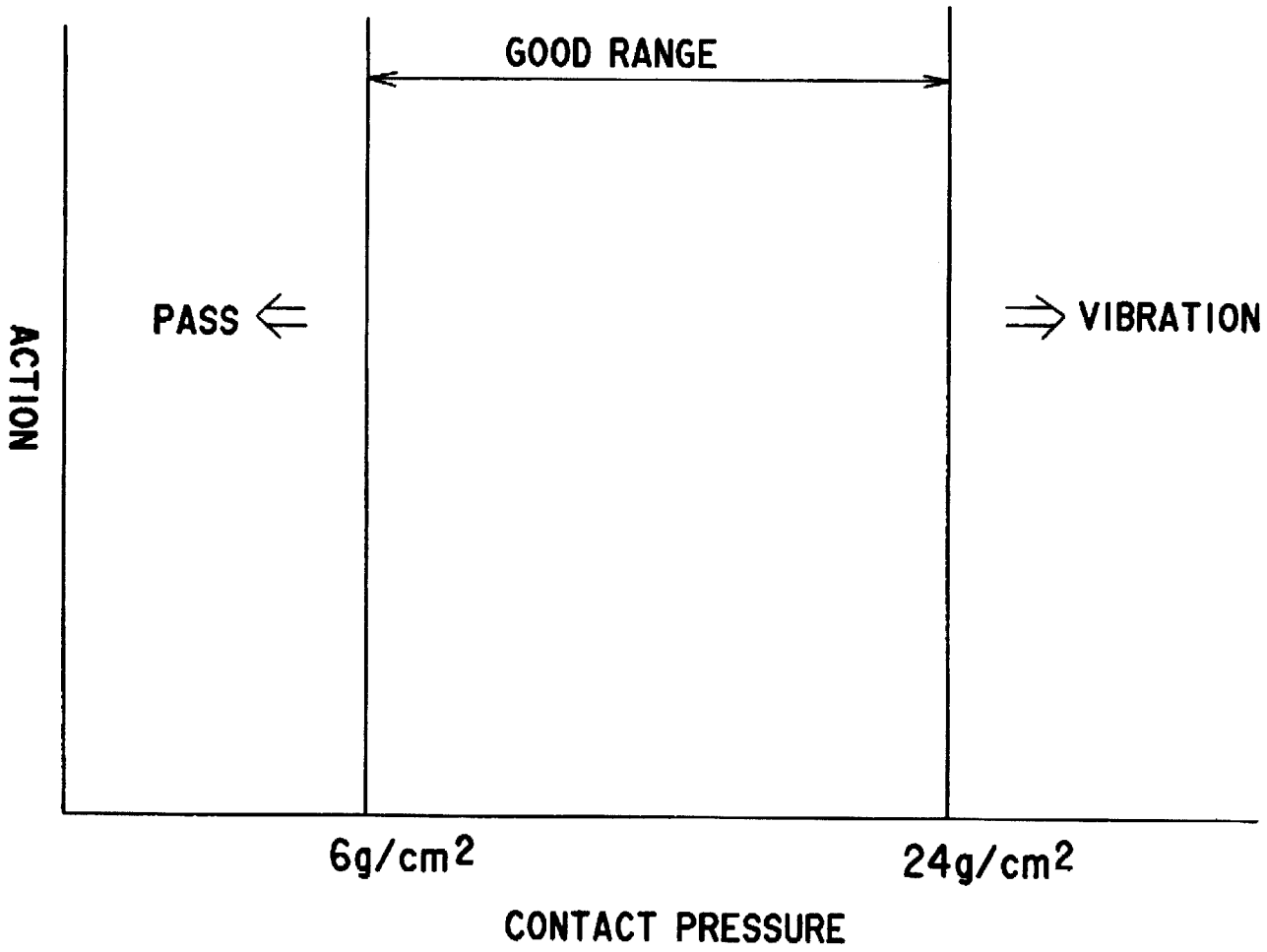
FIG. 24 is a characteristic chart of the rubber blade in FIG. 23.

FIG. 23 is an explanatory diagram of another modification of the distribution member, and FIG. 24 is a characteristic chart of the rubber blade in FIG. 23.

This modification uses a distribution member 28 which takes a different shape from a roller or a brush. As apparent from FIG. 23, a blade 28-5, which is attached to a blade holder 28-3, is used as the distribution member 28 in this modification. This blade 28-5 is made of a conductive rubber (e.g., conductive urethane rubber). The blade 28-5 has a specified precision of its ridge line and is so set as to contact the photosensitive drum 20 with such pressure that toners can pass between the blade 28-5 and the drum 20.

Under this condition, an AC electric field is applied to the blade 28 by the AC power supply 29.

As the blade 28-5 contacts the photosensitive drum 20 over the entire drum surface, the blade 28-5 is always urged to scrape the toners off. Since the AC electric field is applied in this condition, the toners can easily be distributed. The de-electrifying effect by the applied AC electric field is the same as the one produced by the use of the conductive brush.

Generally speaking, the blade 28-5 is cheaper than the conductive brush. Further, it is relatively easier to control the parameters of the blade 28-5, such as the rubber hardness, the thickness, the length and the contacting angle to the drum 20, than the material factors of the conductive brush, such as the electric resistance, the density, the pile length and the thickness, and the attachment factors of the brush, such as the contacting (nip) depth and the width. While the conductive brush raises a problem originating from paper powder sticking on the brush, the rubber blade 28-5 is free of such a problem because fibrous paper powder easily pass under the blade.

As the negative charging is basically performed in the present printing process, paper powder even reaching the developing unit 23 will not raise any problem because the paper powder will act to negatively charge other members or materials.

The contact pressure of the rubber blade 28-5 varies depending on the position the holder 28-3 is attached. The proper contact pressure is to allow toners to pass under the blade. As apparent from FIG. 24 which shows whether or not toners can pass under the urethane rubber blade under different contact pressures, the toners pass under the blade under contact pressure of 6 g/cm$^2$ or lower. When the contact pressure is above 6 g/cm$^2$ and below 24 g/cm$^2$, the toners on the photosensitive drum 20 are cleaned off. If the contact pressure is set between 2 g/cm$^2$ and 6 g/cm$^2$, the toners will pass under the blade as intended. According to this modification, the contact pressure is set to 5 g/cm$^2$.

A seal member 31 is provided in this modification to prevent toners from falling down on the sheet feeding path by the action of the blade 28-5.

Figure 25:
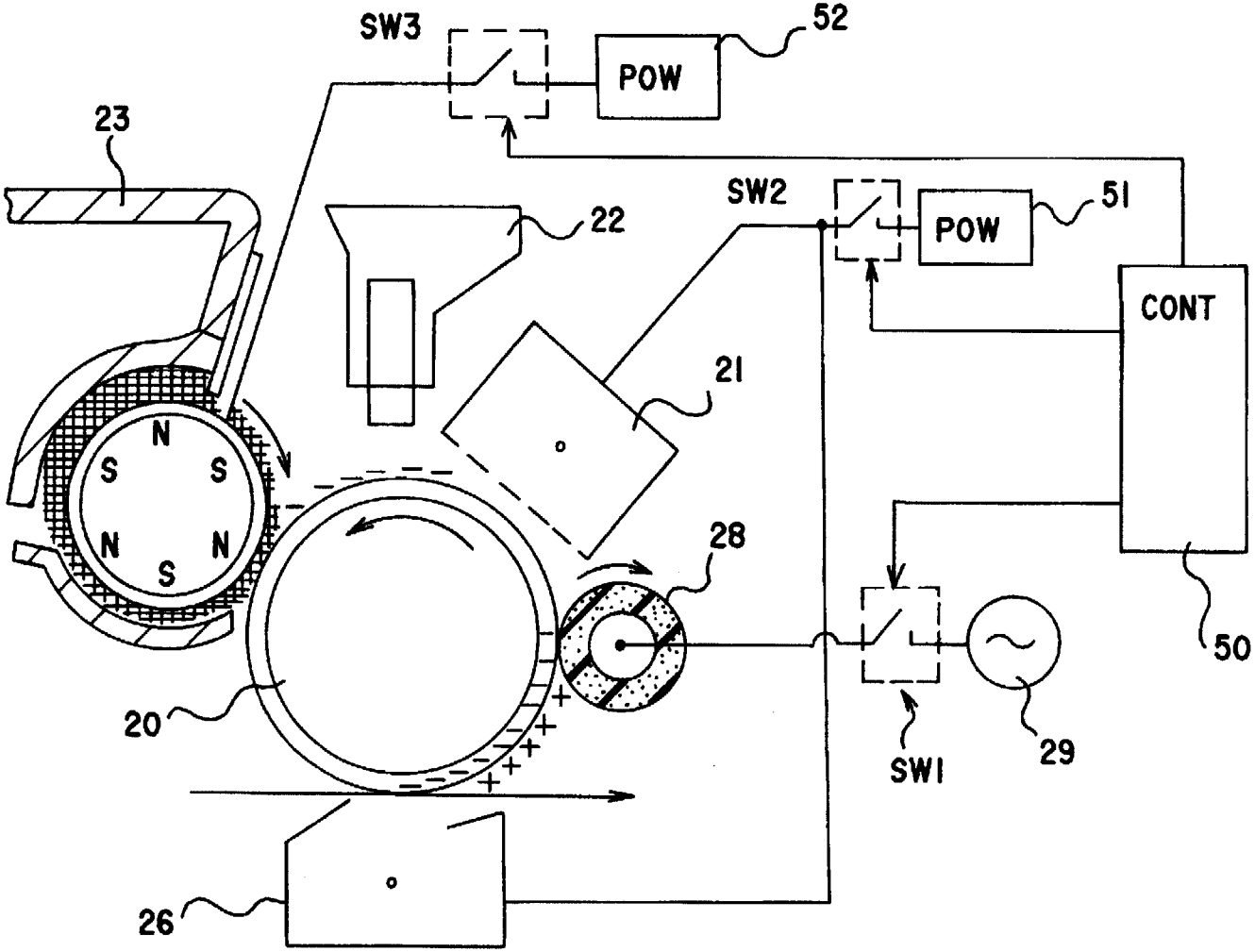
FIG. 25 is a block diagram of a control section according to one embodiment of the present invention.
Figures 26A, 26B, 26C, 26D, 27A, 27B, 27C, 27D:
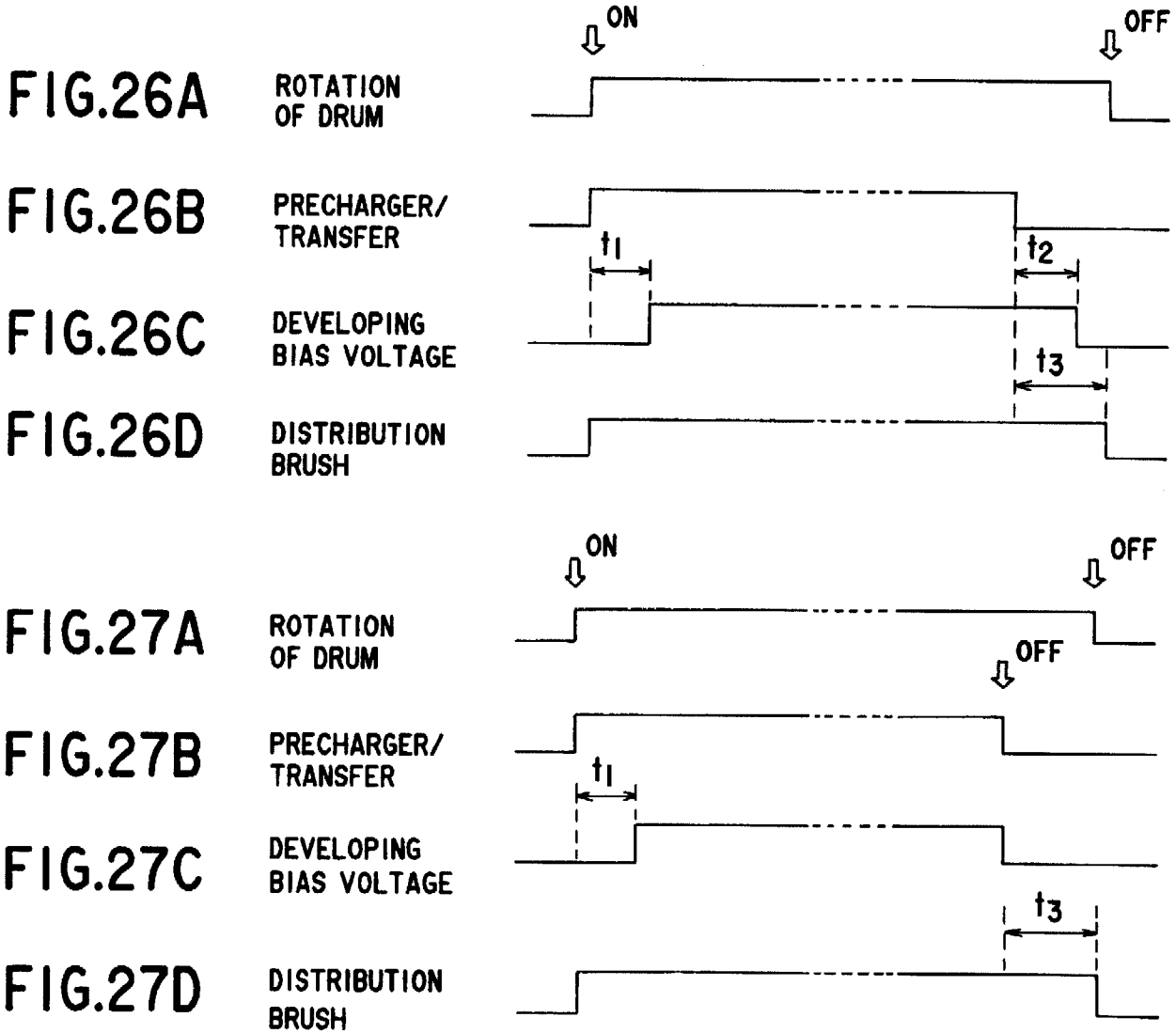
FIG. 26 is a time chart of a voltage-applying sequence in FIG. 25.
FIG. 27 is a time chart of another voltage-applying sequence in FIG. 25.

FIG. 25 is a block diagram of a control section according to one embodiment of the present invention, FIGS. 26 and 27 are explanatory diagrams for voltage-applying sequences.

In FIG. 25, a controller 50 is constituted of a microprocessor. This controller 50 performs the sequence control of the individual sections of the apparatus to form an image. A charging/transferring power supply 51 generates a precharge voltage and a transfer voltage. A developing bias power supply 52 generates a developing bias voltage.

A first switch SW1 permits the voltage from the AC power supply 29 to be applied to the distribution roller 28 in response to an instruction from the controller 50. A second switch SW2 permits the precharge voltage and transfer voltage from the charging/transferring power supply 51 to be applied to the precharger 21 and the transfer unit 26 in response to an instruction from the controller 50. A third switch SW3 permits the developing bias voltage from the developing bias power supply 52 to be applied to the developing unit 23 in response to an instruction from the controller 50.

In this embodiment, the power supply for the precharger 21 and the transfer unit 26 is constituted of one transformer to reduce the cost of the necessary power supplies. With this structure, the precharger 21 and the transfer unit 26 function simultaneously, so that the transfer charging by the transfer unit 26 is executed even between sheets. As a result, the surface potential of the photosensitive drum 20 shifts to the positive side at the position between sheets. However, this will nor raise any problem because the photosensitive drum 20 is de-electrified by the distribution roller 28.

In the termination sequence, if all the power supplies are turned off when the rotation of the photosensitive drum 20 is completed, positive charges remain between the transfer unit 26 and the distribution roller 28 as shown in FIG. 25. There is no guarantee that the positive charges will completely become predetermined charges by the precharging operation the next time the apparatus is activated. Therefore, the precharging and transfer charging are disabled and an AC voltage is applied to the distribution roller 28 until the positively charged portion of the photosensitive drum 20 passes the distribution roller 28. Immediately after that positive portion passes the distribution roller 28, the application of the AC voltage is inhibited and the photosensitive drum 20 is stopped at the same time. In this manner, at least the photosensitive drum 20 will not have the positively charged portion remaining thereon.

As shown in FIG. 26, the controller 50 starts rotating the photosensitive drum 20, and at the same time sets the switches SW1 and SW2 on to apply an AC voltage to the distribution roller 28 and to apply the precharge voltage to the precharger 21 and the transfer voltage to the transfer unit 26. After a time t1 at which the charged portion of the photosensitive drum 20 arrives at the developing unit 23, the controller 50 sets the switch SW3 on to apply the developing bias voltage to the developing unit 23. As a result, no developing operation takes place while the uncharged region of the photosensitive drum 20 faces the developing unit 23. This prevents toners from unnecessarily sticking on the photosensitive drum 20.

In the termination sequence, first, the controller 50 sets the switch SW2 off to disable the application of the precharge voltage and transfer voltage. Then, after a time t2 at which the portion of the photosensitive drum 20 that has passed the precharger 21 before disabling the precharging, arrives at the developing unit 23, the controller 50 sets the switch SW3 off to disable the application of the developing bias voltage. After a time t3 at which the portion of the photosensitive drum 20 that has passed the transfer unit 26 just before disabling the transfer voltage, arrives at the distribution roller 28, the controller 50 sets the switch SW1 off to disable the application of the AC voltage. At the same time, the controller 50 stops rotating the photosensitive drum 20.

FIG. 27 is the operation sequence for the case where the developing bias voltage is prepared by dividing the precharge voltage and transfer voltage. That is, the developing bias voltage is enabled only when the precharge voltage and transfer voltage are enabled. This contributes to reducing the cost of the power supplies.

This sequence will be explained referring to FIG. 27. The controller 50 starts rotating the photosensitive drum 20, and at the same time sets the switches SW1 and SW2 on to apply an AC voltage to the distribution roller 28 and to apply the precharge voltage to the precharger 21 and the transfer voltage to the transfer unit 26. After a time t1 at which the charged portion of the photosensitive drum 20 arrives at the developing unit 23, the controller 50 sets the switch SW3 on to apply the developing bias voltage to the developing unit 23. As a result, no developing operation takes place while the uncharged region of the photosensitive drum 20 faces the developing unit 23. This prevents toners from unnecessarily sticking on the photosensitive drum 20.

In the termination sequence, first, the controller 50 sets the switches SW2 and SW3 off to disable the precharge voltage and transfer voltage as well as the developing bias voltage. After a time t3 at which the portion of the photosensitive drum 20 that has passed the transfer unit 26 just before disabling the transfer voltage, arrives at the distribution roller 28, the controller 50 sets the switch SW1 off to disable the application of the AC voltage. At the same time, the controller 50 stops rotating the photosensitive drum 20.

As an AC electric field is applied to the distribution member 28 for a predetermined period of time after the application of the transfer bias to the transfer unit 26 is disabled, the excess charges by the transfer unit 26 can be eliminated before the print sequence is terminated. Thus, the next print sequence can be executed stably.

Figures 28A, 28B, 28C, 28D, 28E:
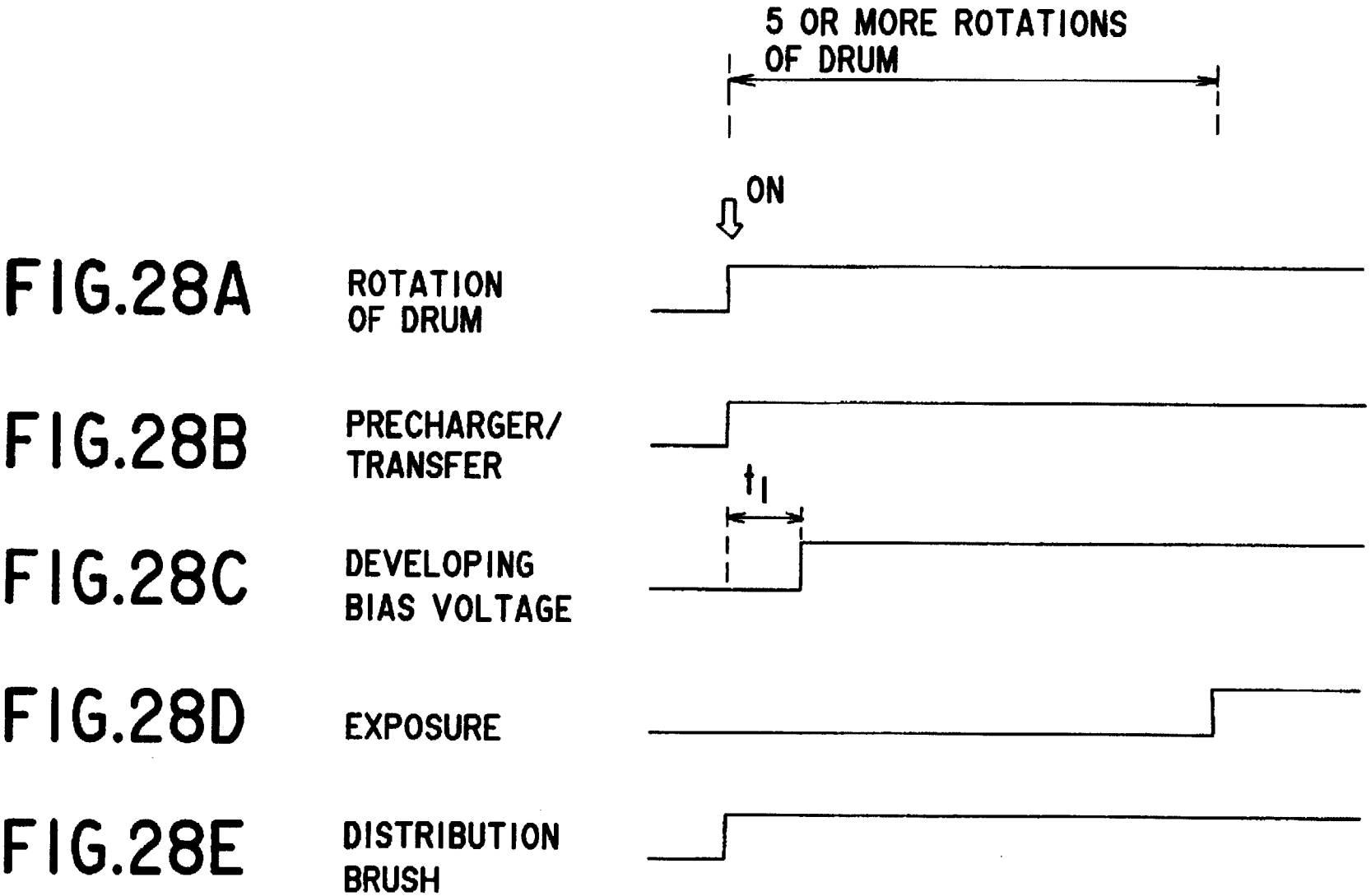
FIG. 28 is an explanatory diagram of a jam recovery sequence in FIG. 25.
Figure 31:
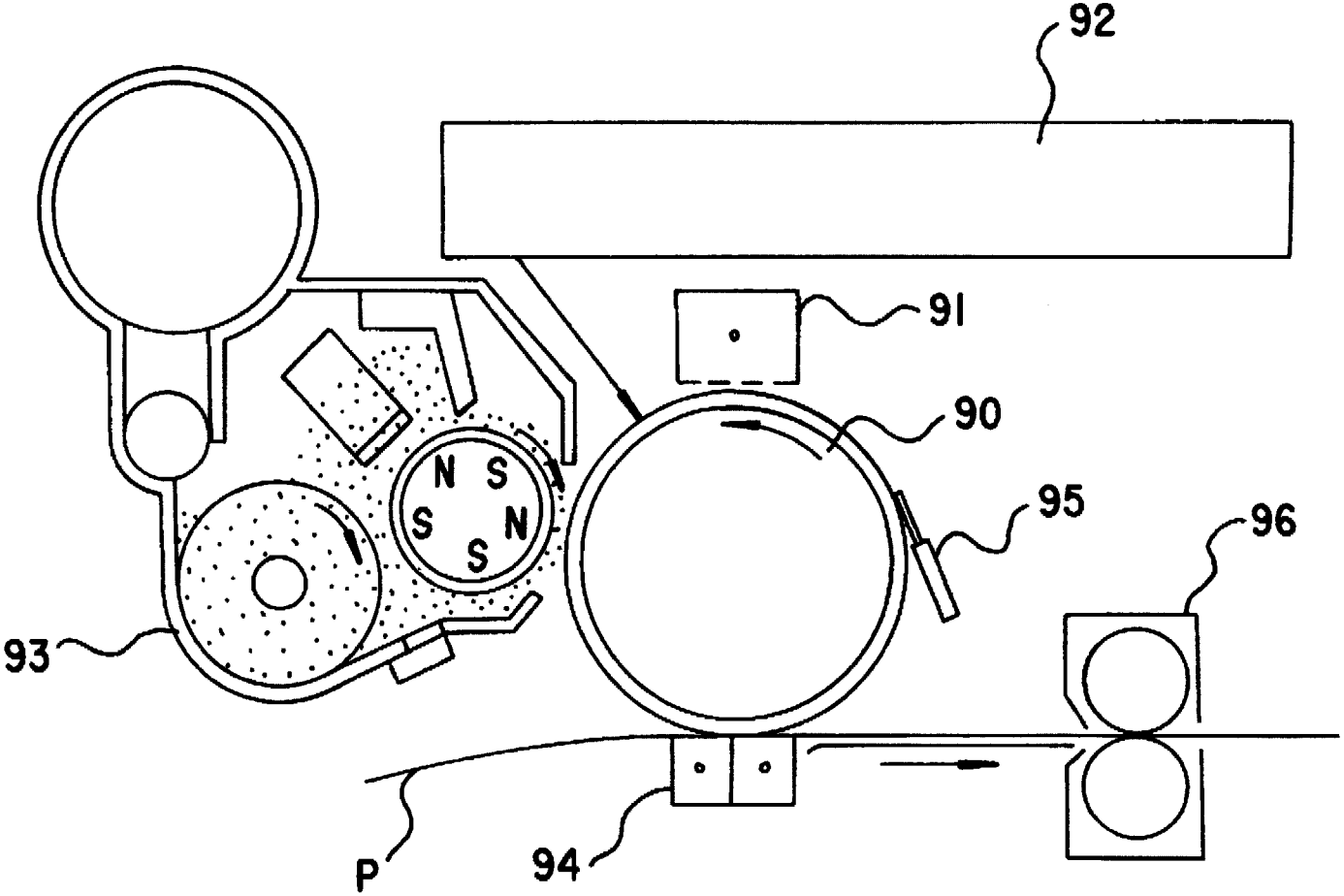
FIG.31 PRIOR ART
FIG. 31 is an explanatory diagram of prior art.

A sequence at the time of jamming recovery will now be described. FIG. 28 is an explanatory diagram of a jam recovery sequence.

A large amount of residual toners and residual charges remain on the photosensitive drum 20 after jamming occurs. To remove them, the toner collection by the developing unit 23 and the de-electrification by the distribution roller 28 should be performed properly. The de-electrifying action of the distribution roller 28 and the toner collecting operation of the developing unit 23 should be performed at least five times.

As shown in FIG. 28, when the photosensitive drum 20 rotates five times consecutively after starting the rotation, exposure is initiated. This way, the influence of the residual toners and residual charges on the photosensitive drum 20 is eliminated and the photosensitive drum 20 returns to the initialized state. At the time jamming occurs, therefore, the ordinary sequence will not be performed. Instead, the jam recovery sequence which makes the best use of the de-electrifying effect of the distribution roller 28 will be conducted, thereby providing a good-quality image even immediately after the occurrence of jamming.

An operational sequence for exchanging the toner cartridge (toner kit) will now be discussed. FIG. 29 is a sequence time chart at the time the toner kit is exchanged, and FIG. 30 is a flowchart for the toner-kit exchanging sequence.

In this apparatus, carrier shifting (movement of the carrier on the photosensitive drum) occurs when the toner density is low, the carrier is at a high charged state and the potential difference between the photosensitive drum 20 and the developing rollers 24 is large. When a toner empty signal is generated and the user exchanges the toner kit with a new one, the toner kit may not be properly installed.

When this happens, the toners will not be supplied to the developing rollers 24 and the toner density decreases, causing the carrier shifting.

In this respect, at the time the toner kit is exchanged with another one, the high-voltage power supply such as the precharging power supply, should be turned on after confirming that the supply roller 232 has touched the surface of the empty sensor and the level of the output of the empty sensor is equal to or higher than a certain level.

In other words, the mentioned high voltage, such as the precharging voltage, will not be applied until the toners are surely supplemented and the toner density increases to a certain level. Even if the toner density becomes low, therefore, no electric field will be generated so that the carrier shifting will not happen.

As shown in FIG. 29, after the exchange of the toner kit, the photosensitive drum 20 starts rotating to turn the supply roller 232 once. When the supply roller 232 makes more than one turn, the output of the toner empty sensor is read. When the amount of toners is found to be equal to or greater than a certain value from the output of the toner empty sensor, the high-voltage power supply is turned on or the precharging voltage and transfer voltage are enabled. Even when the toner kit is exchanged with another one, the conditions of the apparatus are checked before applying a high voltage. This failsafe sequence improves the reliability of the apparatus.

The present invention is not limited to the above-described embodiment, and may be modified in various other manners as follows.

First, although a 1.5-component developer having a combination of the magnetic carrier and magnetic toners is used as a developer in the above-described embodiment, the magnetic toners alone may be used as the developer. In this case, the magnetic toners are stirred to be charged by the toner supply roller 232 in the toner hopper 231. Therefore, the toner supply roller 232 becomes an agitator. Secondly, although only the sleeves of the developing rollers 24 are rotated, the magnet rollers may also be rotated. Thirdly, although the LED optical system has been explained as an image exposing section, a laser optical system, a liquid crystal shutter optical system, an EL (electroluminescent) optical system and so forth may be used as well. Fourthly, although the image forming mechanism has been explained as an electrophotographing mechanism in the foregoing description of the embodiment, another image forming mechanism (like an electrostatic recording mechanism) which transfers a toner image on a sheet may also be used, and sheets are not limited to paper but other types of media can be used as well. Further, the photosensitive body is not limited to a drum type, but may be of an endless belt type.

Fifthly, although the present invention has been explained as a printing apparatus, it may be a different type of image forming apparatus, such as a copying machine or facsimile.

The present invention is not limited to the above-described embodiment, but may be modified in various forms without departing from the spirit and scope of the invention. Therefore, the present examples and embodiment are to be considered as illustrative and not restrictive and the invention is not to be limited to the details given herein, but may be modified within the scope of the appended claims.

In short, according to the present invention, as an AC voltage is applied to the distribution member, the toners can be forcibly moved and are distributed more properly. It is therefore possible to distribute the concentrated residual toners and facilitate the collection of the residual toners in the developing unit. Because of the AC voltage applied to the distribution member, it is also possible to de-electrify the residual charges on the latent image carrier at the same time as the toner distribution.

What is claimed is:

1. An image forming apparatus for forming an image on a sheet, comprising:

a rotary endless latent image carrier;

image forming means for forming an electrostatic latent image on said latent image carrier;

developing means for developing said electrostatic latent image on said latent image carrier with powdery developers and collecting residual toners on said latent image carrier at a same time;

transfer means for transferring said developed image on said latent image carrier onto a sheet;

a distribution member for distributing residual toners on said latent image carrier when in contact with said latent image carrier after image transfer, said distribution member is made of a conductive foam member having a pore at a surface contacting with said latent image carrier; and voltage supplying means for supplying an AC voltage to said distribution member;

wherein said distribution member is a roller, and wherein said roller rotates in a direction opposite to a rotational direction of said latent image carrier; and wherein said roller rotates at a peripheral velocity of 1.1 to 1.5 times faster than a peripheral velocity of said latent image carrier.

2. An image forming apparatus for forming an image on a sheet, comprising:

a rotary endless latent image carrier;

image forming means for forming an electrostatic latent image on said latent image carrier;

developing means for developing said electrostatic latent image on said latent image carrier with powdery developers and collecting residual toners on said latent image carrier at a same time;

transfer means for transferring said developed image on said latent image carrier onto a sheet;

a distribution member for distributing residual toners on said latent image carrier when in contact with said latent image carrier after image transfer, said distribution member is made of a conductive foam member having a pore at a surface contacting with said latent image carrier; and voltage supplying means for supplying an AC voltage to said distribution member;

wherein said distribution member is a roller; wherein said roller has independent foam perforations; wherein said roller rotates in a direction opposite to a rotational direction of said latent image carrier; and wherein said roller rotates at a peripheral velocity of 1.1 to 1.5 times faster than a peripheral velocity of said latent image carrier.

3. An image forming apparatus for forming an image on a sheet, comprising:

a rotary endless latent image carrier;

image forming means for forming an electrostatic latent image on said latent image carrier;

developing means for developing said electrostatic latent image on said latent image carrier with powdery developers and collecting residual toners on said latent image carrier at a same time;

transfer means for transferring said developed image on said latent image carrier onto a sheet;

a distribution member for distributing residual toners on said latent image carrier when in contact with said latent image carrier after image transfer, said distribution member is made of a conductive foam member having a pore at a surface contacting with said latent image carrier; and voltage supplying means for supplying an AC voltage to said distribution member;

wherein said voltage supplying means supplies a voltage to said distribution member which is equal to or higher than a voltage required to cause de-electrifying of said rotary endless latent image carrier.

4. The image forming apparatus according to claim 3, wherein said distribution member is a conductive roller made of a foam member.

5. The image forming apparatus according to claim 4, wherein said roller has independent foam perforations.

6. The image forming apparatus according to claim 4, wherein said roller rotates in a direction opposite to a rotational direction of said latent image carrier.

7. The image forming apparatus according to claim 6, wherein said roller rotates at a peripheral velocity of 1.1 to 1.5 times faster than a peripheral velocity of said latent image carrier.

8. An image forming apparatus for forming an image on a sheet, comprising:

a rotary endless latent image carrier;

image forming means for forming an electrostatic latent image on said latent image carrier;

developing means for developing said electrostatic latent image on said latent image carrier with powdery developers and collecting residual toners on said latent image carrier at a same time;

transfer means for transferring said developed image on said latent image carrier onto a sheet;

a distribution member for distributing residual toners on said latent image carrier when in contact with said latent image carrier after image transfer, said distribution member is made of a conductive foam member having a pore at a surface contacting with said latent image carrier; and voltage supplying means for supplying an AC voltage to said distribution member;

wherein said voltage supplying means supplies a voltage of a frequency of 150 to 250 Hz to said distribution member; and wherein said voltage supplying means supplies a voltage to said distribution member which is equal to or higher than a voltage required to cause de-electrifying of said rotary endless latent image carrier.

9. An image forming apparatus for forming an image on a sheet, comprising:

a rotary endless latent image carrier;

image forming means for forming an electrostatic latent image on said latent image carrier;

developing means for developing said electrostatic latent image on said latent image carrier with powdery developers and collecting residual toners on said latent image carrier at a same time;

transfer means for transferring said developed image on said latent image carrier onto a sheet;

a distribution member for distributing residual toners on said latent image carrier when in contact with said latent image carrier after image transfer, said distribution member is made of a conductive foam member having a pore at a surface contacting with said latent image carrier; and voltage supplying means for supplying an AC voltage to said distribution member;

wherein said roller rotates in a direction opposite to a rotational direction of said latent image carrier; wherein said distribution member is a conductive roller made of a foam member; and wherein said voltage supplying means supplies a voltage of a frequency of 150 to 250 Hz to said distribution member; and wherein said roller rotates at a peripheral velocity of 1.1 to 1.5 times faster than a peripheral velocity of said latent image carrier.

10. An image forming apparatus for forming an image on a sheet, comprising:

a rotary endless latent image carrier;

image forming means for forming an electrostatic latent image on said latent image carrier;

developing means for developing said electrostatic latent image on said latent image carrier with powdery developers and collecting residual toners on said latent image carrier at a same time;

transfer means for transferring said developed image on said latent image carrier onto a sheet;

a distribution member for distributing residual toners on said latent image carrier when in contact with said latent image carrier after image transfer, said distribution member is made of a conductive foam member having a pore at a surface contacting with said latent image carrier; and voltage supplying means for supplying an AC voltage to said distribution member;

further comprising a paper-powder removing member, provided between said distribution member and said transfer means and being made of an insulating brush, for removing paper powder off said latent image carrier.

11. An image forming apparatus for forming an image on a sheet, comprising:

a rotary endless latent image carrier;

image forming means for forming an electrostatic latent image on said latent image carrier;

developing means for developing said electrostatic latent image on said latent image carrier with powdery developers and collecting residual toners on said latent image carrier at a same time;

transfer means for transferring said developed image on said latent image carrier onto a sheet;

a distribution member for distributing residual toners on said latent image carrier when in contact with said latent image carrier after image transfer, said distribution member is made of a conductive foam member having a pore at a surface contacting with said latent image carrier; and voltage supplying means for supplying an AC voltage to said distribution member;

further comprising a scatter preventing member, provided at a side of said distribution member closer to said image forming means, for preventing said residual toners from scattering.

12. An image forming apparatus for forming an image on a sheet, comprising:

a rotary endless latent image carrier;

image forming means for forming an electrostatic latent image on said latent image carrier;

developing means for developing said electrostatic latent image on said latent image carrier with powdery developers and collecting residual toners on said latent image carrier at a same time;

transfer means for transferring said developed image on said latent image carrier onto a sheet;

a distribution member for distributing residual toners on said latent image carrier when in contact with said latent image carrier after image transfer, said distribution member is made of a conductive foam member having a pore at a surface contacting with said latent image carrier; and voltage supplying means for supplying an AC voltage to said distribution member;

further comprising control means for stopping application of the AC voltage to said distribution member when a predetermined time passes after stopping application of an electric weld to said transfer means.

13. An image forming apparatus for forming an image on a sheet, comprising:

a rotary endless latent image carrier;

image forming means for forming an electrostatic latent image on said latent image carrier;

developing means for developing said electrostatic latent image on said latent image carrier with powdery developers and collecting residual toners on said latent image carrier at a same time;

transfer means for transferring said developed image on said latent image carrier onto a sheet; and a distribution roller for distributing residual toners on said latent image carrier when in contact with said latent image carrier after image transfer, said distribution roller is made of a foam member having a pore at a surface contacting with said latent image carrier;

wherein said roller rotates in a direction opposite to a rotational direction of said latent image carrier; and wherein said roller rotates at a peripheral velocity of 1.1 to 1.5 times faster than a peripheral velocity of said latent image carrier.

14. An image forming apparatus for forming an image on a sheet, comprising:

a rotary endless latent image carrier;

image forming means for forming an electrostatic latent image on said latent image carrier;

developing means for developing said electrostatic latent image on said latent image carrier with powdery developers and collecting residual toners on said latent image carrier at a same time;

transfer means for transferring said developed image on said latent image carrier onto a sheet;

voltage supplying means for supplying an AC voltage; and a distribution member, supplied with the AC voltage from said voltage supplying means, for distributing residual toners on said latent image carrier when in contact with said latent image carrier after image transfer, said distribution member including:

a first conductive brush whose distal end contacts said latent image carrier, the first conductive brush creates a first distribution effect and a first de-electrifying effect to the latent image carrier; and a second conductive brush whose distal end contacts said latent image carrier at a different position along a moving direction of said latent image carrier, the second conductive brush creates a second distribution effect which is higher than that of the first conductive brush and a second de-electrifying effect to the latent image carrier which is lower than that of the first conductive brush.

15. The image forming apparatus according to claim 14, wherein said apparatus further comprises a support block for supporting said first conductive brush and said second conductive brush, said support block having a shape matching with a shape of said latent image carrier at a position where said first conductive brush and said second conductive brush contacts said latent image carrier.

16. The image forming apparatus according to claim 14, wherein said voltage supplying means supplies a voltage to said distribution member which is equal to or higher than a voltage required to cause de-electrifying of said rotary endless latent image carrier.

17. The image forming apparatus according to claim 14, wherein said voltage supplying means supplies a voltage of a frequency of 150 to 250 Hz to said distribution member.

18. An image forming apparatus for forming an image on a sheet, comprising:

a rotary endless latent image carrier;

image forming means for forming an electrostatic latent image on said latent image carrier;

developing means for developing said electrostatic latent image on said latent image carrier with powdery developers and collecting residual toners on said latent image carrier at a same time;

transfer means for transferring said developed image on said latent image carrier onto a sheet;

a distribution roller for distributing residual toners on said latent image carrier when in contact with said latent image carrier after image transfer, said distribution roller rotates at a peripheral velocity of 1.1 to 1.5 times faster than a peripheral velocity of said latent image carrier; said distribution roller is made of a conductive foam member having a pore at a surface contacting with said latent image carrier; and voltage supplying means for supplying an AC voltage to said distribution roller.

19. An image forming apparatus for forming an image on a sheet, comprising:

a rotary endless latent image carrier;

image forming means for forming an electrostatic latent image on said latent image carrier;

developing means for developing said electrostatic latent image on said latent image carrier with powdery developers and collecting residual toners on said latent image carrier at a same time;

transfer means for transferring said developed image on said latent image carrier onto a sheet;

a distribution roller for distributing residual toners on said latent image carrier when in contact with said latent image carrier after image transfer;

voltage supplying means for supplying an AC voltage to said distribution roller; and jam recovery means for controlling the image forming means, the developing means, and the voltage supplying means, to control said latent image carrier to rotate at least five times with performing developing of said developing means and supplying the AC voltage by said voltage supplying means and without forming an electrostatic latent image by said image forming means during a jam recovery sequence after starting the rotation of said latent image carrier.

* * * * *